US006843212B2

(12) United States Patent
Shimizu et al.

(10) Patent No.: US 6,843,212 B2
(45) Date of Patent: Jan. 18, 2005

(54) ENGINE WITH VARIABLE COMPRESSION RATIO

(75) Inventors: Yasuhiro Shimizu, Wako (JP); Sei Watanabe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,195

(22) Filed: Mar. 19, 2003

(65) Prior Publication Data

US 2004/0003785 A1 Jan. 8, 2004

(30) Foreign Application Priority Data

Mar. 20, 2002 (JP) ..... 2002-079737
Jan. 24, 2003 (JP) ..... 2003-016533

(51) Int. Cl.[7] ..... F02B 75/04

(52) U.S. Cl. ..... 123/48 B; 123/78 F

(58) Field of Search ..... 123/48 B, 78 F

(56) References Cited

FOREIGN PATENT DOCUMENTS

| | | | |
|---|---|---|---|
| EP | 1 167 720 A1 | 1/2002 | ..... 75/32 |
| EP | 1 170 482 A2 | 1/2002 | ..... 75/4 |
| EP | 1 178 194 A2 | 2/2002 | ..... 75/4 |
| JP | 9-228853 | 9/1997 | |
| JP | 2002054468 | 2/2002 | ..... 15/2 |

*Primary Examiner*—Noah P. Kamen
(74) *Attorney, Agent, or Firm*—Arent Fox PLLC

(57) ABSTRACT

An engine with a variable compression ratio includes a connecting rod connected to a piston, a first arm turnably connected to the connecting rod and to a crankshaft through a crankpin, a second arm integrally connected to the first arm, a control rod turnably connected to the second arm, and a displaceable support shaft for supporting the other end of the control rod for turning movement. In the engine, a displacement Vhpiv0 and a compression ratio εpiv0 at the time when the support shaft is in any first position and a displacement Vhpiv1 and a compression ratio εpiv1 at the time when the support shaft is in a second position displaced from the first position are determined, and a relation, Vhpiv1>Vhpiv0 is satisfied when εpiv1<εpiv0, and a relation, Vhpiv1<Vhpiv0 is satisfied when εpiv1>εpiv0.

4 Claims, 22 Drawing Sheets

118
122
121
87
88
21
116
117'
109
22
22
113
121
85
113a
61
69
99
114a
97
86
114
102
108
21
110

24
23
39
38a
40
38
125
126
127
(Xetdc−Xptdc)
H1

ENGINE WITH VARIABLE COMPRESSION RATIO

BACKGROUND OF THE INVENTION

1. Field of the Invention

The present invention relates to an engine with a variable compression ratio, comprising a connecting rod connected at one end to a piston through a piston pin, a first arm turnably connected at one end to the other end of the connecting rod and at the other end to a crankshaft through a crankpin, a second arm integrally connected at one end to the other end of the first arm, a control rod turnably connected at one end to the other end of the second arm, and a support shaft for supporting the other end of the control rod for turning movement, the position of the support shaft being displaceable within an x-y plane constituted by an x-axis extending through an axis of the crankshaft along a cylinder axis and a y-axis extending through the axis of the crankshaft in a direction perpendicular to the x-axis.

2. Description of the Related Art

Such engine is conventionally known, for example, from Japanese Patent Application Laid-open No. 9-228853 or the like, and is designed so that the compression ratio is varied in accordance with the operational state.

To provide an increase in efficiency of the engine at high temperatures, it is desirable that not only the compression ratio is varied, but also the displacement is variable. In the conventionally known engine, however, the displacement remains kept constant.

SUMMARY OF THE INVENTION

Accordingly, it is an object of the present invention to provide an engine with a variable compression ratio, wherein not only the compression ratio but also the displacement can be varied.

To achieve the above object, according to a first aspect and feature of the present invention, there is provided An engine with a variable compression ratio, comprising a connecting rod connected at one end to a piston through a piston pin, a first arm turnably connected at one end to the other end of said connecting rod and at the other end to a crankshaft through a crankpin, a second arm integrally connected at one end to the other end of said first arm, a control rod turnably connected at one end to the other end of said second arm, and a support shaft for supporting the other end of said control rod for turning movement, the position of said support shaft being displaceable within an x-y plane constituted by an x-axis extending through an axis of said crankshaft along a cylinder axis and a y-axis extending through the axis of said crankshaft in a direction perpendicular to said x-axis, wherein when a length of said connecting rod is represented by L4; a length of said first arm is represented by L2; a length of said second arm is represented by L1; a length of said control rod is represented by L3; an angle formed by said connecting rod with said x-axis is represented by $\phi$4; an angle formed by said first and second arms is represented by $\alpha$; an angle formed by said second arm with said y-axis is represented by $\phi$1; an angle formed by said control rod with said y-axis is represented by $\phi$3; an angle formed by a straight line connecting the axis of said crankshaft and said crankpin with said x-axis is represented by $\theta$; a length between the axis of said crankshaft and said crankpin is represented by R; x-y coordinates of said support shaft are represented by Xpiv and Ypiv; a rotational angular speed of said crankshaft is represented by $\omega$; and an amount of offsetting of said cylinder axis from the axis of said crankshaft in a direction of the y-axis is represented by $\delta$, the following equation is established:

$$-L4\cdot\sin\phi4\cdot d\phi4/dt+L2\cdot\cos(\alpha+\phi1)\cdot d\phi1/dt-R\cdot\omega\cdot\sin\theta=0$$

wherein $\phi4=\arcsin\{L2\cdot\cos(\alpha+\phi1)+R\cdot\sin\theta-\delta\}/L4$ $d\phi4/dt=\omega\cdot\{-L2\cdot\sin(\alpha+\phi1)\cdot R\cdot\cos(\theta-\phi3)/L1\cdot\sin(\phi1+\phi3)+R\cdot\cos\theta\}/(L4\cdot\cos\phi4)$ $\phi3=\arcsin\{(R\cdot\cos\theta-Xpiv+L1\cdot\sin\phi1)\}/L3\}$ $\phi1=\arcsin\{(L3^2-L1^2-C^2-D^2)/2\cdot L1\cdot\sqrt{(C^2+D^2)}\}-\arctan(C/D)$ $C=Ypiv-R\sin\theta$ $D=Xpiv-R\cos\theta$ $d\phi1/dt=\omega\cdot R\cdot\cos(\theta-\phi3)/\{L1\cdot\sin(\phi1+\phi3)\}$, and the crank angles $\theta$ at a top dead center and a bottom dead center of said piston pin at the time when said support shaft is in a first position are determined by introducing L1, to L4, $\delta$ and R each set at any value into said equation; a displacement Vhpiv0 and a compression ratio $\epsilon$piv0 at the time when said support shaft is in the first position and a displacement Vhpiv1 and a compression ratio $\epsilon$piv1 at the time when said support shaft is in a second position displaced from the first position are determined from the following equation representing a level X of said piston pin at both said crank angles $\theta$:

$$X=L4\cdot\cos\phi4+L2\cdot\sin(\alpha+\phi1)+R\cdot\cos\theta;$$

and the length L1, of said second arm, the length L2 of said first arm, the length L3 of said control rod, the length L4, of said connecting rod, the amount $\delta$ of offsetting of the cylinder axis from the axis of said crankshaft in the direction of the y-axis and the angle $\alpha$ formed by said first and second arms are determined, so that the following relations are satisfied:

$$Vhpiv1>Vhpiv0 \text{ when } \epsilon piv1<\epsilon piv0, \text{ and}$$

$$Vhpiv1<Vhpiv0 \text{ when } \epsilon piv1>\epsilon piv0.$$

The operation according to the configuration of the first feature will be described below with reference to FIG. 7 diagrammatically showing the arrangements of the piston pin, the connecting rod, the crankshaft, the crankpin, the first arm, the second arm, the control rod and the support shaft. When the coordinates (Xpiv and Ypiv) of the support shaft are determined, a moving speed (dX/dt) of the piston pin is determined by differentiating the position of the piston pin in the direction of the x-axis determined by $\{X=L4\cdot\cos\phi4+L2\cdot\sin(\alpha+\phi1)+R\cdot\cos\theta\}$, and an equation provided when $dX/d=0$ has two solutions in a range of $0<\theta<2\pi$. When the two solutions are associated with the motion of a 4-cycle engine, and the crank angle with the piston pin at the top dead center is represented by $\theta$pivtdc, and the crank angle with the piston pin 63 at the bottom dead center is represented by $\theta$pivbdc, the position of the piston pin at each of the crank angles $\theta$pivtdc and $\theta$pivbdc is determined by providing $\theta$pivtdc and $\theta$pivbdc to $\{X=L4\cdot\cos\phi4+L2\cdot\sin(\alpha+\phi1)+R\cdot\cos\theta\}$. Here, when the position of the piston pin at the top dead center in the direction of the x-axis is represented by Xpivtdc, and the position of the piston pin at the bottom dead center in the direction of the x-axis is represented by Xpivbdc, a stroke Spiv of the piston pin is determined by (Xpivtdc−Xpivbdc). When the inner diameter of a cylinder bore in the engine is represented by B, a displacement Vhipv is determined according to {Vhpiv=Spiv·($B^2$/4)·π}. When a volume of a combustion engine at the top dead center is represented by Vapiv, a compression ratio εpiv is determined according to {εpiv=1+ (Vhpiv/Vapiv) }. In this manner, the displacement $Vhpiv_0$ and the compression ratio $\epsilon piv_0$ at the time when the support shaft is in the first position and the displacement $Vhpiv_1$ and the compression ratio $\epsilon piv_1$ at the time when the support shaft is in the second position, are determined, and the length L1 of the second arm, the length L2 of the first arm, the length L3 of the control rod, the length L4 of the connecting rod, the amount δ of offsetting of the cylinder axis from the axis of the crankshaft in the direction of the y-axis and the angle α formed by the first and second arms are determined, so that the following relations are satisfied:

Vhpiv1>Vhpiv0 when εpiv1<εpiv0, and

Vhpiv1<Vhpiv0 when εpiv1>εpiv0.

Thus, when the displacement is larger, the engine can be operated at a lower compression ratio, and when the displacement is smaller, the engine can be operated at a higher compression ratio. Therefore, when a load is lower, the engine can be operated at the smaller displacement and the higher compression ratio, thereby providing an increase in thermal efficiency. When a load is higher, the engine can be operated at the larger displacement and the lower compression ratio, thereby preventing the explosion load and the pressure in a cylinder from rising excessively to avoid problems in noise and strength.

According to a second aspect and feature of the present invention, in addition to the first feature, a locus of movement of the piston pin is determined to be fallen into a range between the x-axis and a straight line extending in parallel to the x-axis through one of positions of points of connection between the connecting rod and the first arm when the piston is at the top dead center, which is farthest from the x-axis in the direction of the y-axis. With such feature, it is possible to reduce the friction during sliding of the piston. More specifically, at a first half of an expansion stroke, the piston receives a large load due to the combustion in the combustion chamber, but the angle of inclination of the connecting rod can be suppressed at the first half of the expansion stroke and hence, it is possible to reduce the friction.

According to a third aspect and feature of the present invention, in addition to the first or second feature, when a level of the piston pin in the direction of the x-axis at the top dead center at the time when the displacement is smallest is represented by Xetdc; a level of the piston pin in the direction of the x-axis at the top dead center at the time when the displacement is largest is represented by Xptdc; and a width of a top land of the piston is represented by H1, these values are determined so that a relation, Xetdc−Xptdc≦H1 is established.

When the displacement is largest, a portion of an inner surface of a cylinder bore is also exposed to the combustion chamber, and hence, there is a possibility that carbon produced from the combustion is deposited and accumulated to the portion of the inner surface of the cylinder bore. When this state is kept intact, the piston ring mounted on the piston slides on the accumulated carbon, thereby causing disadvantages such as sticking and abnormal wear of the piston ring and poor sealing of combustion gas. However, by establishing Xetdc−Xptdc≦H1 according to the third feature, it is possible to prevent the piston ring from sliding on the accumulated carbon when the displacement is smallest, thereby eliminating the above-described disadvantages.

According to a fourth aspect and feature of the present invention, in addition to any of the first to third features, the support shaft is displaced to describe a circular locus having a radius Rp about a point spaced within the x-y plane by lengths L5 and L6 apart from the axis of the crankshaft in the directions of the y-axis and the x-axis, respectively, and wherein when the length R between the axis of the crankshaft and the crankpin is set at 1.0, the length L1, of the second arm is set in a range of 1.5 to 6.0; the length L2 of the first arm is set in a range of 1.0 to 5.5; the length L3 of the control rod is set in a range of 3.0 to 6.0; the length L5 is set in a range of 1.2 to 6.0; the length L6 is set in a range of 0.9 to 3.8; and the radius Rp is set in a range of 0.06 to 0.76, as well as the angle α formed by the first and second arms is set in a range of 77 to 150 degrees.

The configuration of the fourth feature encompasses the configurations of the second and third features. Thus, it is possible to reduce the friction during sliding of the piston and to prevent the piston ring from sliding on the accumulated carbon, thereby eliminating the disadvantages such as sticking and abnormal wear of the piston ring and poor sealing of combustion gas.

The above and other objects, features and advantages of the invention will become apparent from the following description of the preferred embodiments taken in conjunction with the accompanying drawings.

BRIEF DESCRIPTION OF THE DRAWINGS

FIGS. 1 to 10 show a first embodiment of the present invention, wherein

FIG. 1 is a front view of an engine;

FIG. 2 is a vertical sectional view of the engine, taken along a line 2—2 in FIG. 3;

FIG. 3 is a sectional view taken along a line 3—3 in FIG. 2;

FIG. 4 is a sectional view taken along a line 4—4 in FIG. 3;

FIG. 5 is an enlarged sectional view taken along a line 5—5 in FIG. 1 in a lower-load state;

FIG. 6 is a sectional view similar to FIG. 5 but in a higher-load state;

FIG. 7 is a diagram showing the arrangement of a link mechanism;

FIG. 8 is a graph showing the relationship among the phase of a shaft, the displacement and the compression ratio;

FIG. 10 is a graph showing the relationship between the average effective pressure and the specific rate of fuel consumption.

FIGS. 11 and 12 show a second embodiment of the present invention, wherein FIG. 11 is a front view of a locking member;

FIG. 12 is a view taken in a direction of an arrow 12 in FIG. 11.

FIGS. 13 to 18 show a third embodiment of the present invention, wherein FIG. 13 is a front view of essential portions of an engine;

FIG. 14 is a sectional view taken along a line 14—14 in FIG. 13 in a lower-load state of the engine;

FIG. 15 is a sectional view taken along a line 15—5 in FIG. 14;

FIG. 16 is a sectional view taken along a line 16—16 in FIG. 15;

FIG. 17 is a sectional view similar to FIG. 15 but in a higher-load state of the engine;

FIG. 18 is a sectional view taken along a line 18—18 in FIG. 17.

FIGS. 19 to 24 show a fourth embodiment of the present invention, wherein FIG. 19 is a front view of essential portions of an engine;

FIG. 20 is a sectional view taken along a line 20—20 in FIG. 19;

FIG. 21 is a sectional view taken along a line 21—21 in FIG. 20 in a lower-load state of the engine;

FIG. 22 is a sectional view taken along a line 22—22 in FIG. 20 in the lower-load state of the engine;

FIG. 23 is a sectional view similar to FIG. 21 but in a higher-load state of the engine;

FIG. 24 is a sectional view similar to FIG. 22 but in a higher-load state of the engine.

FIGS. 25 to 27 show a fifth embodiment of the present invention, wherein

FIG. 27 is a diagram showing the arrangement of the link mechanism.

DESCRIPTION OF THE PREFERRED EMBODIMENTS

Figure 1:
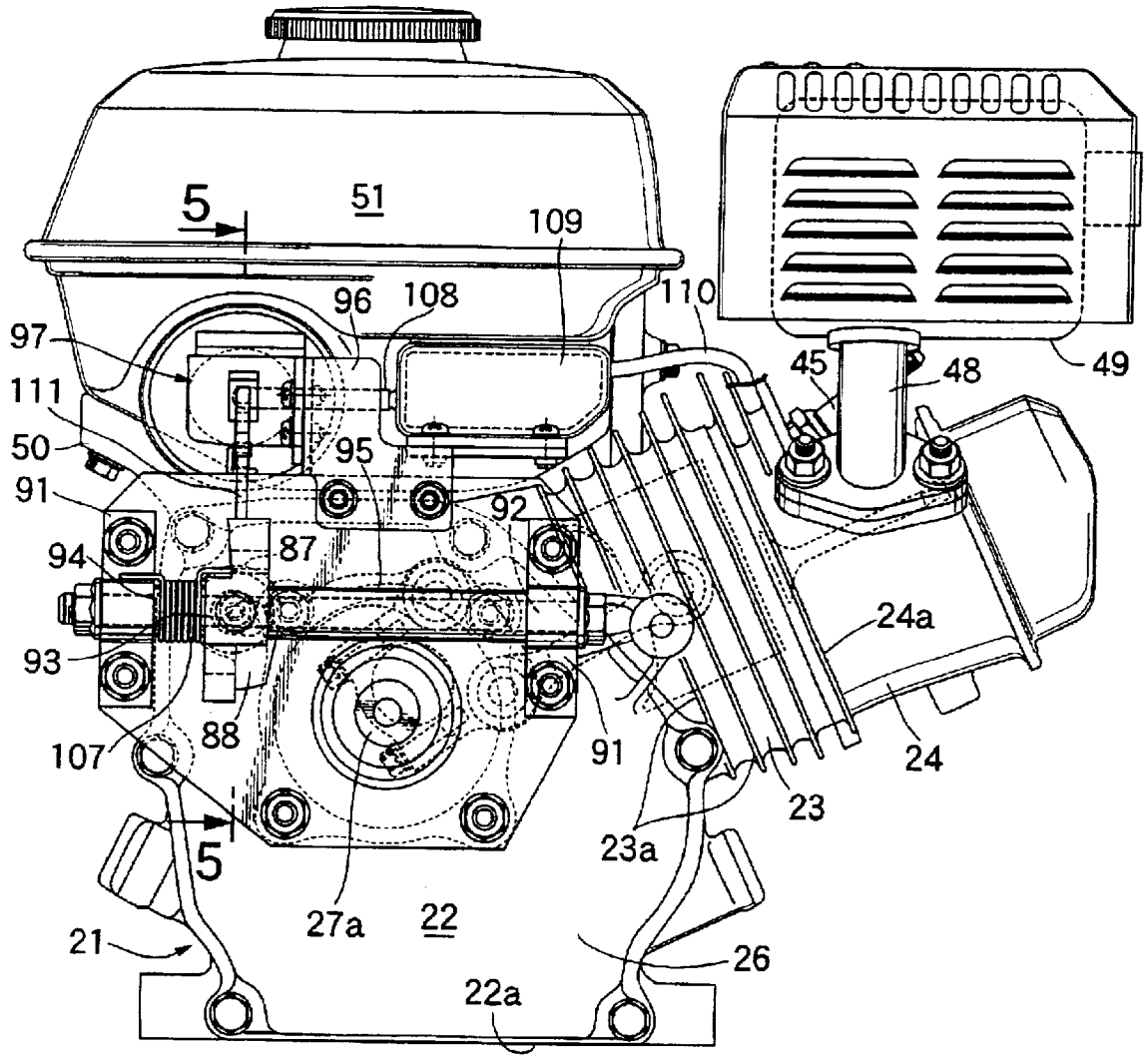
Figure 2:
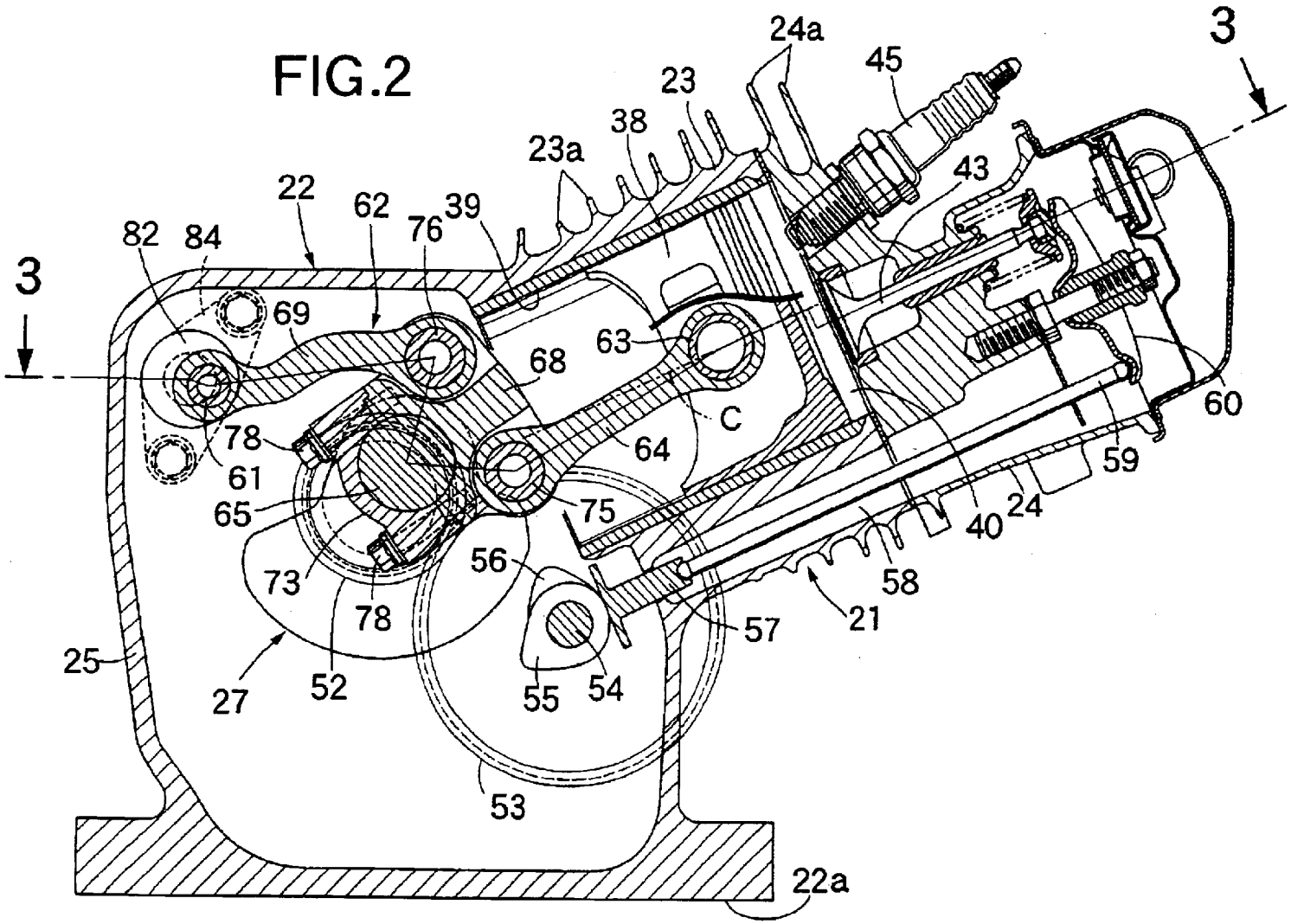
Figure 3:
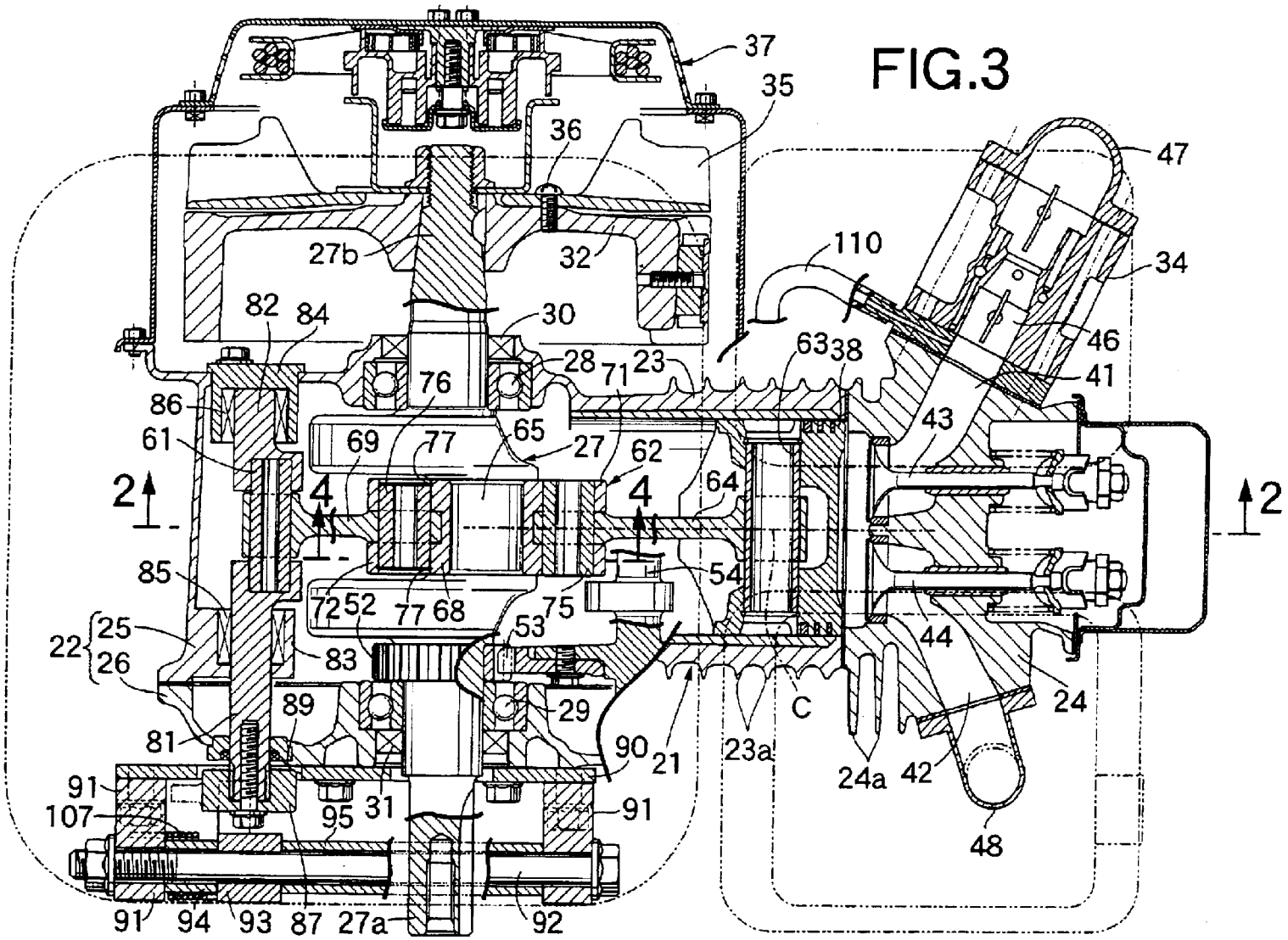

A first embodiment of the present invention will now be described with FIGS. 1 to 10. Referring first to FIGS. 1 to 3, an engine according to the first embodiment is an air-cooled single-cylinder engine used, for example, in a working machine or the like, and includes an engine body 21 which is comprised of a crankcase 22, a cylinder block 23 protruding in a slightly upward inclined state from one side of the crankcase 22, and a cylinder head 24 coupled to a head portion of the cylinder block 23. Large numbers of air-cooling fins 23*a* and 24*a* are provided on outer surfaces of the cylinder block 23 and the cylinder head 24. A mounting face 22*a* on a lower surface of the crankcase 22 is mounted on an engine bed of each of various working machines The crankcase 22 comprises a case body 25 formed integrally with the cylinder block 23 by a casting process, and a side cover 26 coupled to an open end of the case body 25, and a crankshaft 27 are rotatably carried at its opposite ends on the case body 25 and the side cover 26 with ball bearings 28 and 29 and oil seals 30 and 31 interposed therebetween. One end of the crankshaft 27 protrudes as an output shaft portion 27*a* from the side cover 26, and the other end of the crankshaft 27 protrudes as an auxiliary-mounting shaft portion 27*b* from the case body 25. Moreover, a flywheel 32 is fixed to the auxiliary-mounting shaft portion 27*b*; a cooling fan 35 for supplying cooling air to various portions of the engine body 21 and a carburetor 34 is secured to an outer surface of the flywheel 32 by a screw member 36, and a recoil-type engine stator 37 is disposed outside the cooling fan 36.

A cylinder bore 39 is defined in the cylinder block 23, and a piston 38 is slidably received in the cylinder bore 39. A combustion chamber 40 is defined between the cylinder block 23 and the cylinder head 24, so that a top of the piston is exposed to the combustion chamber 40.

An intake port 41 and an exhaust port 42 are defined in the cylinder head 24 and lead to the combustion chamber 40, and an intake valve 43 for connecting and disconnecting the intake port 41 and the combustion chamber 40 to and from each other and an exhaust valve 44 for connecting and disconnecting the exhaust port 42 and the combustion chamber 40 to and from each other are openably and closably disposed in the cylinder head 24. A spark plug 45 is threadedly fitted into the cylinder head 24 with its electrodes facing to the combustion chamber 40.

The carburetor 34 is connected to an upper portion of the cylinder head 24, and a downstream end of an intake passage 46 included in the carburetor 34 communicates with the intake port 41. An intake pipe 47 leading to an upstream end of the intake passage 46 is connected to the carburetor 34 and also connected to an air cleaner (not shown). An exhaust pipe 48 leading to the exhaust port 42 is connected to the upper portion of the cylinder head 24 and also connected to an exhaust muffler 49. Further, a fuel tank 51 is disposed above the crankcase 22 in such a manner that it is supported on a bracket 50 protruding from the crankcase 22.

A driving gear 52 is integrally formed on the crankshaft 27 at a location closer to the side cover 26 of the crankcase 22, and a driven gear 53 meshed with the driving gear 52 is secured to a camshaft 54 rotatably carried in the crankcase 22 and having an axis parallel to the crankshaft 27. Thus, a rotating power from the crankshaft 27 is transmitted to the camshaft 4 at a reduction ratio of ½ by the driving gear 52 and the driven gear 53 meshed with each other.

The camshaft 54 is provided with an intake cam 55 and an exhaust cam 56 corresponding to the intake valve 43 and the exhaust valve 44, respectively, and a follower piece 57 operably carried on the cylinder block 23 is in sliding contact with the intake cam 55. On the other hand, an operating chamber 58 is defined in the cylinder block 23 and the cylinder head 24, so that an upper portion of the follower piece 57 protrudes from a lower portion of the operating chamber 58; and a pushrod 59 is disposed in the operating chamber 58 with its lower end abutting against the follower piece 57. On the other hand, a rocker arm 60 is swingably carried on the cylinder head 24 with its one end abutting against an upper end of the exhaust valve 44 biased in a closing direction by a spring, and an upper end of the pushrod 59 abuts against the other end of the rocker arm 60. Thus, the pushrod 59 is operated axially in response to the rotation of the intake cam 55, and the intake valve 43 is opened and closed by the swinging of the rocker arm 60 caused in response to the operation of the pushrod 59.

A mechanism similar to that between the intake cam 55 and the intake valve 43 is also interposed between the exhaust cam 56 and the exhaust valve 44, so that the exhaust valve 44 is opened and closed in response to the rotation of the exhaust cam 56.

Figure 4:
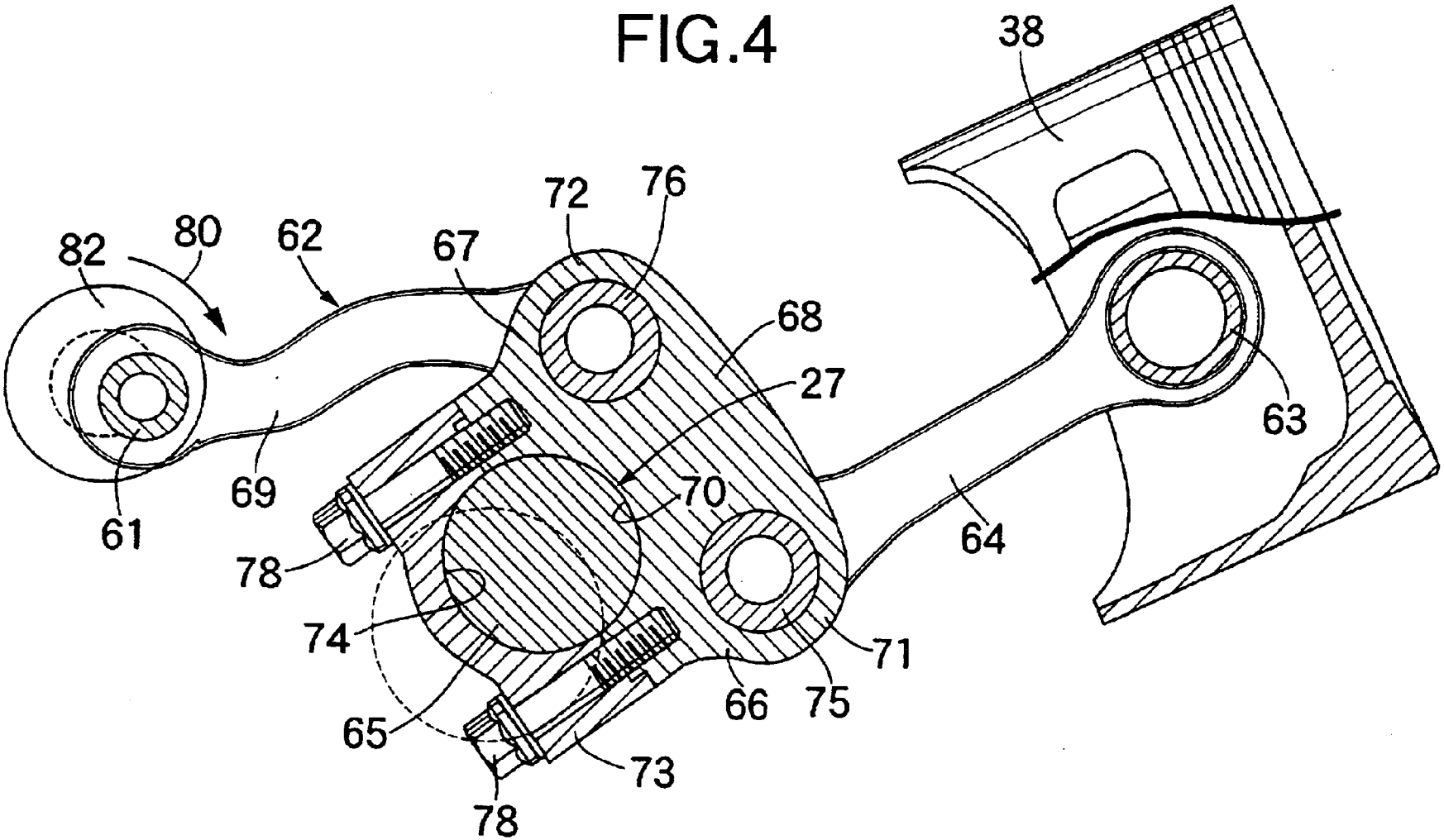

Referring also to FIG. 4, the piston 38, the crankshaft 27 and a support shaft 61 carried in the crankcase 22 of the engine body 21 for displacement in a plane extending through a cylinder axis C and perpendicular to an axis of the crankshaft 27, are connected to one another through a link mechanism 62.

The link mechanism 62 comprises a connecting rod 64 connected at one end to the piston 38 through a piston pin 63, a first arm 66 turnably connected at one end to the other end of the connecting rod 64 and at the other end to a crankpin 65 of the crankshaft 27, a second arm 67 integrally connected at one end to the other end of the first arm 66, and a control rod 69 turnably connected at one end to the other end of the second arm 67 and at other end to the support shaft 61. The first and second arms 66 and 67 are integrally formed as a subsidiary rod 68.

The subsidiary rod 68 includes a semi-circular first bearing portion 70 provided at its intermediate portion to come into sliding contact with half of a periphery of the crankpin 65, and a pair of bifurcated portions 71 and 72 provided at its opposite ends, so that the other end of the connecting rod 64 and one end of the control rod 69 are sandwiched therebetween. A semi-circular second bearing portion 74 included in the crank cap 73 is in sliding contact with the remaining half of the periphery of the crankpin 65 of the crankshaft 27, and the crank cap 73 is fastened to the subsidiary rod 68.

The connecting rod 64 is turnably connected at the other end thereof to one end of the subsidiary rod 68, i.e., to one end of the first arm 66 through a connecting rod pin 75, which is press-fitted into the other end of the connecting rod 64 and turnably fitted at its opposite ends into the bifurcated portion 71 at one end of the subsidiary rod 68.

The control rod 69 is turnably connected at one end to the other end of the subsidiary rod 68, i.e., to the other end of the second arm 67 through a cylindrical subsidiary rod pin 76, which is passed relatively turnably through one end of the control rod 69 inserted into the bifurcated portion 72 at the other end of the subsidiary rod 68, and which is clearance-fitted at its opposite end into the bifurcated portion 72 at the other end of the subsidiary rod 68. Moreover, a pair of clips 77, 77 are mounted to the bifurcated portion 72 at the other end of the subsidiary rod 68 to abut against the opposite ends of the subsidiary rod pin 76 for inhibiting the removal of the subsidiary rod pin 76 from the bifurcated portion 72.

The crank cap 73 is fastened to the bifurcated portions 71 and 72 by disposed pair by pair at opposite sides of the crankshaft 27, and the connecting rod pin 75 and the subsidiary rod pin 76 are disposed on extensions of axes of the bolts 78, 78.

Figure 5:
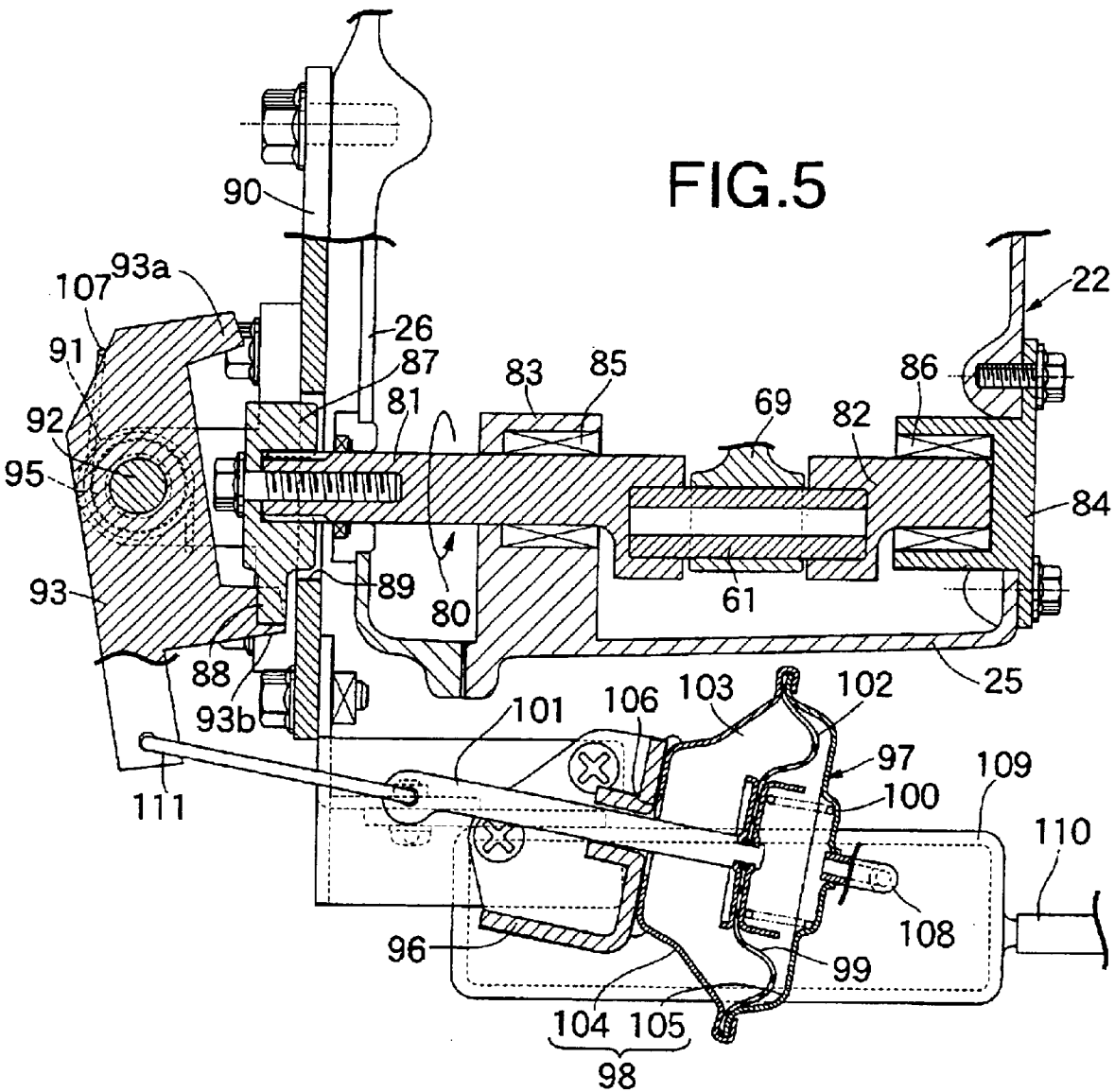
Figure 6:
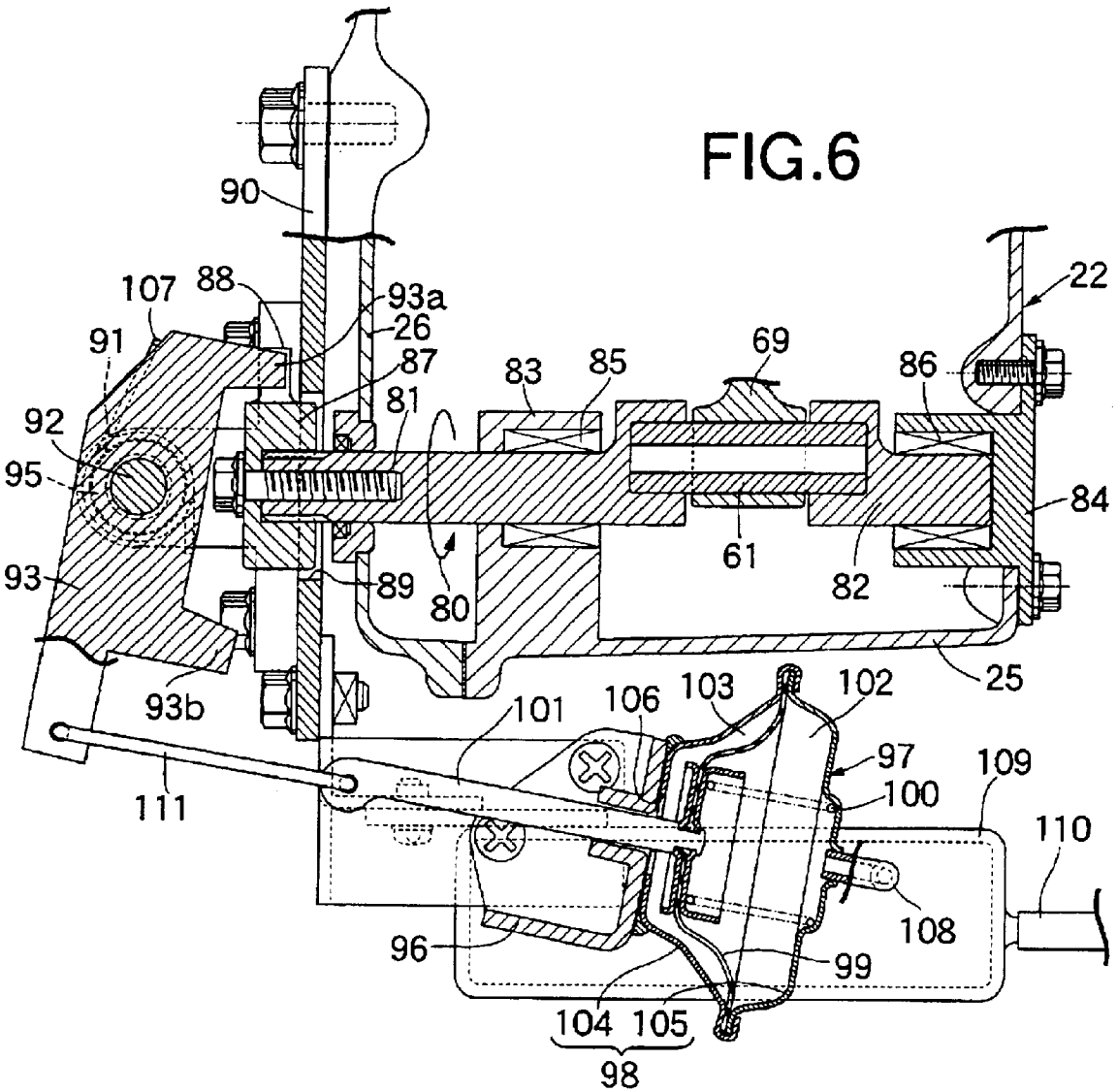

Referring further to FIG. 5, the cylindrical support shaft 61 is mounted between eccentric positions of a pair of rotary shafts 81 and 82 coaxially disposed and having axes parallel to the crankshaft 27. Moreover, the rotary shaft 81 is carried on a support portion 83 provided integrally at an upper portion of the case body 25 of the crankcase 22 with a one-way clutch 85 interposed therebetween, and the rotary shaft 82 is carried on a support portion 84 mounted to the case body 25 with a one-way clutch 86 interposed therebetween.

The control rod 69 connected at the other end to the support shaft 61, alternately receives a load in a direction to compress the control rod 69 and a load in a direction to pull the control rod 69, in accordance with the motion cycle of the engine. Because the support shaft 61 is mounted between the eccentric positions of the rotary shafts 81 and 82, a rotational force from the control rod 69 to one side of each of the rotary shafts 81 and 82 and a rotational force to the other side, are also alternately applied to each of the rotary shafts 81 and 82. However, the rotary shafts 81 and 82 can rotate only in one direction indicated by an arrow 80, because the one-way clutches 85, 86 are interposed between the rotary shafts 81, 82 and the support portions 83, 84.

A locking member 87 is fixed to one end of the rotary shaft 81 rotatably protruding to the outside through the side cover 26 of the crankcase 22. The locking member 87 is formed into a disk-shape having a restraining projection 88 protruding radially outwards at circumferentially one point.

On the other hand, a support plate 90 having an opening 89 into which a portion of the locking member 87 and a pair of brackets 91, 91 protruding outwards from the support plate 90, are fastened to an outer surface of the side cover 26 of the crankcase 22. A shaft member 92 disposed at a location outside the locking member 87 and having an axis perpendicular to an axis of the rotary shaft 81 is fixedly supported at its opposite ends on the brackets 91, 91, respectively.

A locker member 93 is swingably carried on the shaft member 92 and has a pair of engagement portions 93*a* and 93*b* capable of engaging with the restraining projection 88 of the locking member 87 at locations where their phases are displaced from each other, for example, by 167 degrees. In order to determine the position of the locker member 93 along the axis of the shaft member 92, cylindrical spacers 94 and 95 are interposed between the brackets 91, 91 and the rocker member 93 to surround the shaft member 92. In addition, a return spring 107 is mounted between the locker member 93 and the support plate 90 for biasing the rocker member 93 for turning movement in a direction to bring one 93*a* of the engagement portions 93*a* and 93*b* of the locker member 93 into engagement with the restraining projection 88.

A diaphragm-type actuator 97 is connected to the locker member 93. The actuator 97 includes a casing 98 mounted to a bracket 96 mounted on the support plate 90, a diaphragm 99 supported in the casing 98 to partition the inside of the casing 98 into a negative pressure chamber 102 and an atmospheric pressure chamber 103, a spring 100 mounted under compression between the casing 98 and the diaphragm 99 to exert a spring force in a direction to increase the volume of the negative pressure chamber 102, and a operating rod 101 connected to a central portion of the diaphragm 99.

The casing 98 comprises a bowl-shaped first case half 104 mounted to the bracket 96, and a bowl-shaped second case half 105 caulked to the case half 104. A peripheral edge of the diaphragm 99 is clamed between opening edges of the case halves 104 and 105. The negative pressure chamber 102 is defined between the diaphragm 99 and the second case half 105, and the spring 100 is accommodated in the negative pressure chamber 102.

The atmospheric pressure chamber 103 is defined between the diaphragm 99 and the first case half 104. The operating rod 101 protrudes, through a through-bore 106 provided in a central portion of the second case half 104, into the atmospheric pressure chamber 103, and is connected at one end to a central portion of the diaphragm 99. The atmospheric pressure chamber 103 communicates with the outside through a gap between an inner periphery of the through-bore 106 and an outer periphery of the operating rod 101.

A conduit 108 leading to the negative pressure chamber 102 is connected to the second case half 105 of the casing 98. On the other hand, a surge tank 109 is supported on the bracket 96 at a location adjoining the actuator 97. The conduit 108 is connected to the surge tank 109. A conduit 110 leading to the surge tank 109 is connected to a downstream end of the intake passage 46 in the carburetor 34. Thus, an intake negative pressure drawn in the intake passage 46 is introduced into the negative pressure chamber 102 in the actuator 97, and the surge tank 109 functions to damp the pulsation of the intake negative pressure.

The other end of the operating rod 101 of the actuator 97 is connected to the locker member 93 through a connecting rod 111. When the engine is in a lower-load operative state in which the negative pressure in the negative pressure chamber 102 is higher, the diaphragm 99 is in a state in which it has been flexed to decrease the volume of the negative pressure chamber 102 against the spring forces of the return spring 107 and the spring 100, as shown in FIG. 5, so that the operating rod 101 is contracted. In this state, the turned position of the locker member 93 is a position in which one 93*b* of the engagement portions 93*a* and 93*b* is in engagement with the restraining projection 88 of the locking member 87.

On the other hand, when the engine is brought into a higher-load operative state in which the negative pressure in the negative pressure chamber 102 is lower, the diaphragm 99 is flexed to increase the volume of the negative pressure chamber 102 by the spring forces of the return spring 107 and the spring 100, so that the operating rod 101 is expanded. Thus, the locker member 93 is turned to a position in which it permits one 93*a* of the engagement portions 93*a* and 93*b* to be brought into engagement with the restraining projection 88 of the locking member 87.

By turning the locker member 93 in the above manner, the rotation of the rotary shafts 81 and 82 receiving a rotational force applied thereto in one direction during operation of the engine, is restrained in a position in which any one of the engagement portions 93*a* and 93*b* is in engagement with the restraining projection 88 of the locking member 87 rotated along with one 81 of the rotary shafts. When the rotation of the rotary shafts 81 and 82 is stopped in two positions different in phase from each other, for example, by 167 degrees, the support shaft 61 located in a position eccentric from the axes of the rotary shafts 81 and 82, i.e., the other end of the control rod 69 is displaced between two positions in a plane perpendicular to the axis of the crankshaft 27, whereby the compression ratio in the engine is changed.

Figure 7:
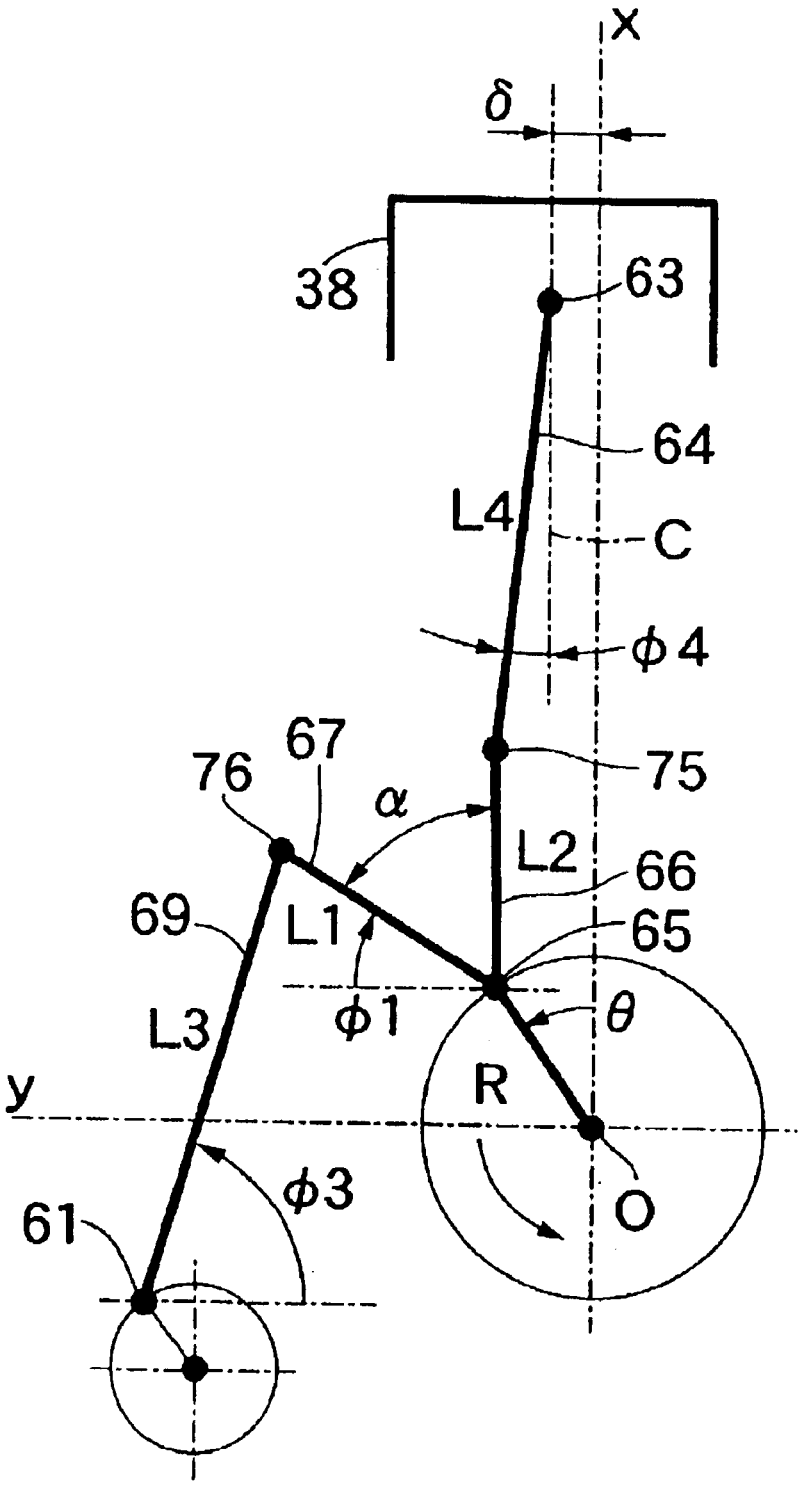

Moreover, the link mechanism 62 is constructed so that not only the compression ratio but also the stroke of the piston 38 can be changed, and the dimensional relationship in the link mechanism 62 for this purpose will be described below with reference to FIG. 7.

Here, when various dimensions are represented as described below in an x-y plane constituted by an x-axis extending through the axis of the crankshaft 27 along the cylinder axis C and a y-axis extending through the axis of the crankshaft 27 in a direction perpendicular to the x-axis, i.e., a length of the connecting rod 64 is represented by L4; a length of the first arm 66 is represented by L2; a length of the second arm 67 is represented by L1; a length of the control rod 69 is represented by L3; an angle formed by the connecting rod 64 with the x-axis is represented by $\phi$4; an angle formed by the first and second arms 66 and 67 is represented by $\alpha$; an angle formed by the second arm 67 with the y-axis is represented by $\phi$1; an angle formed by the control rod 69 with the y-axis is represented by $\phi$3; an angle formed by a straight line connecting the axis of the crankshaft 27 and the crankpin 65 with the x-axis is represented by $\theta$; a length between the crankshaft 27 and the crankpin 65 is represented by R; x-y coordinates of the support shaft are represented by Xpiv and Ypiv; a rotational angular speed of the crankshaft is represented by $\omega$; and an amount of offsetting of the cylinder axis C from the axis of the crankshaft 27 in a direction of the y-axis is represented by $\delta$, a level X of the piston pin 63 is determined according to $$X = L4\cdot\cos\phi4 + L2\cdot\sin(\alpha+\phi1) + R\cdot\cos\theta \quad (1)$$

wherein $\phi4 = \arcsin\{L2\cdot\cos(\alpha+\phi1) + R\cdot\sin\theta - \delta\}/L4$ $\phi1 = \arcsin\{(L3^2 - L1^2 - C^2 - D^2)/2\cdot L1\cdot\sqrt{(C^2+D^2)}\} - \arctan(C/D)$ $C = Ypiv - R\sin\theta$ $D = Xpiv - R\cos\theta$ Here, a speed of the piston pin 63 in a direction of the x-axis is determined according to the following equation by differentiating the above-described equation (1):

$$dX/dt = -L4\cdot\sin\phi4\cdot(d\phi4/dt) + L2\cdot\cos(\alpha+\phi1)\cdot(d\phi1/dt) - R\cdot\omega\cdot\sin\theta \quad (2)$$

Wherein $d\phi4/dt = \omega\cdot\{-L2\cdot\sin(\alpha+\phi1)\cdot R\cdot\cos(\theta-\phi3)/L1\cdot\sin(\phi1+\phi3) + R\cdot\cos\theta\}/(L4\cdot\cos\phi4)$ $\phi3 = \arcsin\{(R\cdot\cos\theta - Xpiv + L1\cdot\sin\phi1)/L3\}$ $d\phi1/dt = \omega\cdot R\cdot\cos(\theta-\phi3)/\{L1\cdot\sin(\phi1+\phi3)\}$ An equation in a case where dX/d=0 in the above-described equation (2) has two solutions when $\theta$ is in a range of $0<\theta<2\pi$. If the two solutions are associated with the motion of a 4-cycle engine, and when a crank angle with the piston pin 63 at a top dead center is represented by $\theta$pivtdc, and a crank angle with the piston pin 63 at a bottom dead center is represented by $\theta$pivbdc, the position of the piston pin 63 at each of the crank angles $\theta$pivtdc and $\theta$pivbdc is determined by providing $\theta$pivtdc and $\theta$pivbdc to the above-described equation (1). In this case, when the position of the piston pin 63 at the top dead center in the direction of the x-axis is represented by Xpivtdc and the position of the piston pin 63 at the bottom dead center in the direction of the x-axis is represented by Xpivbdc, a stroke Spiv of the piston pin 63 is obtained according to (Xpivtdc−Xpivbdc).

Here, when an inner diameter of the cylinder bore 39 is represented by B, a displacement Vhpiv is determined according to $\{Vhpiv = Spiv\cdot(B^2/4)\cdot\pi\}$, and when the volume of the combustion chamber at the top dead center is represented by Vapiv, a compression ratio $\epsilon$piv is determined according to $\{\epsilon piv = 1 + (Vhpiv/Vapiv)\}$.

In the above manner, a displacement Vhpiv0 and a compression ratio $\epsilon$piv when the support shaft 61 is in any first position and a displacement Vhpiv1 and a compression ratio $\epsilon$piv when the support shaft 61 has been displaced from the first position to a second position, are determined, and the length L1, of the second arm 67, the length L2 of the first arm 66, the length L3 of the control rod 69, the length L4, of the connecting rod 64, the amount $\delta$ of offsetting of the cylinder axis C from the axis of the crankshaft 27 in the direction of the y-axis and the angle $\alpha$ formed by the first and second arms 66 and 67 are determined so that the following relations are satisfied:

$$Vhpiv1 > Vhpiv0 \text{ when } \epsilon piv1 < \epsilon piv0$$

$$Vhpiv1 < Vhpiv0 \text{ when } \epsilon piv1 > \epsilon piv0$$

Figure 8:
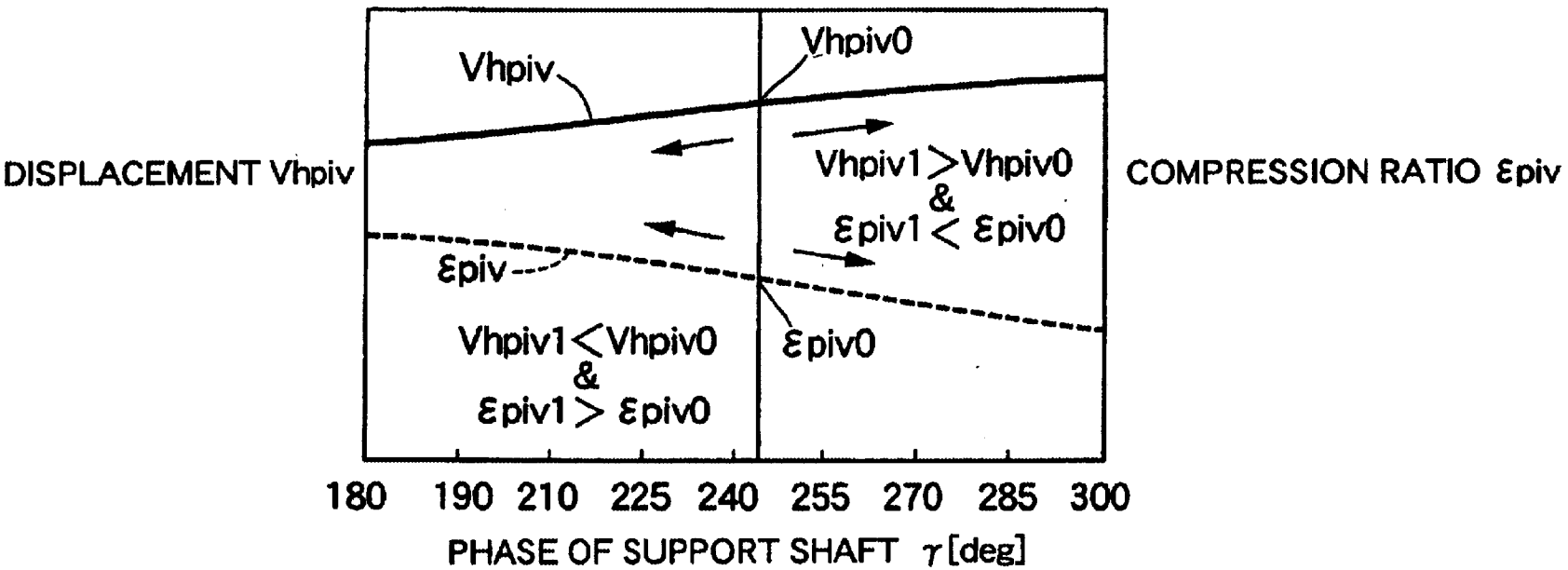

If the various values are determined in the above manner, the displacement Vhpiv and the compression ratio $\epsilon$piv are varied in opposite directions in accordance with the change in phase of the support shaft 61, as shown in FIG. 8. Therefore, when the displacement is larger, the engine can be operated at a lower compression ratio, and when the displacement is smaller, the engine can be operated at a higher compression ratio.

Figure 9A:
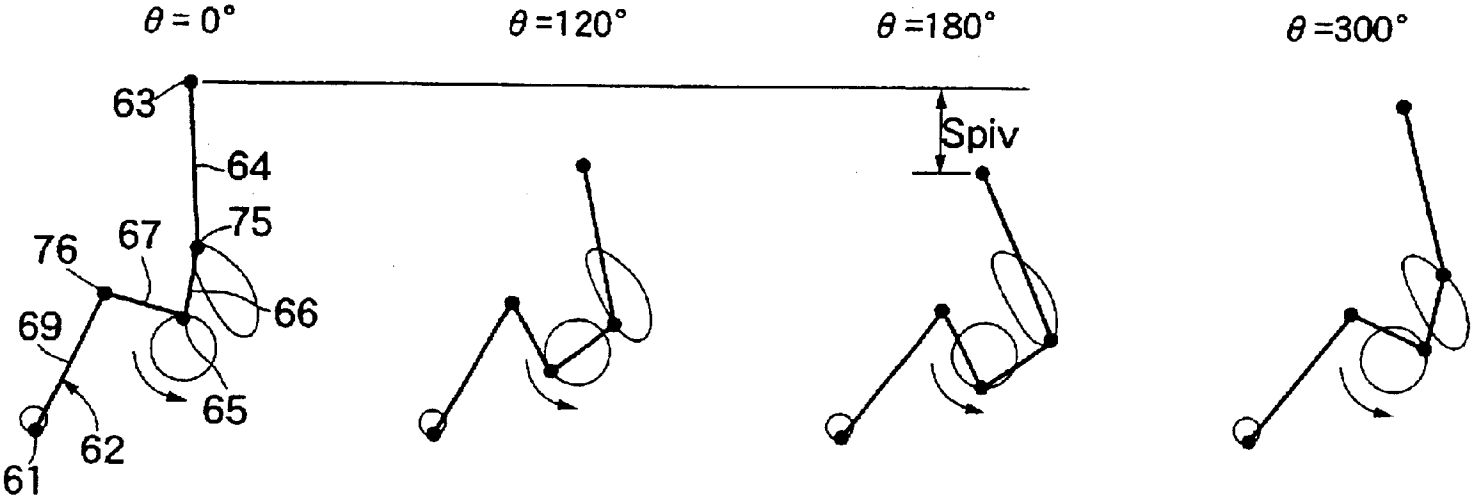
FIG. 9A is a diagram sequentially showing operative states of the link mechanism in a lower-load state of the engine.
Figure 9B:
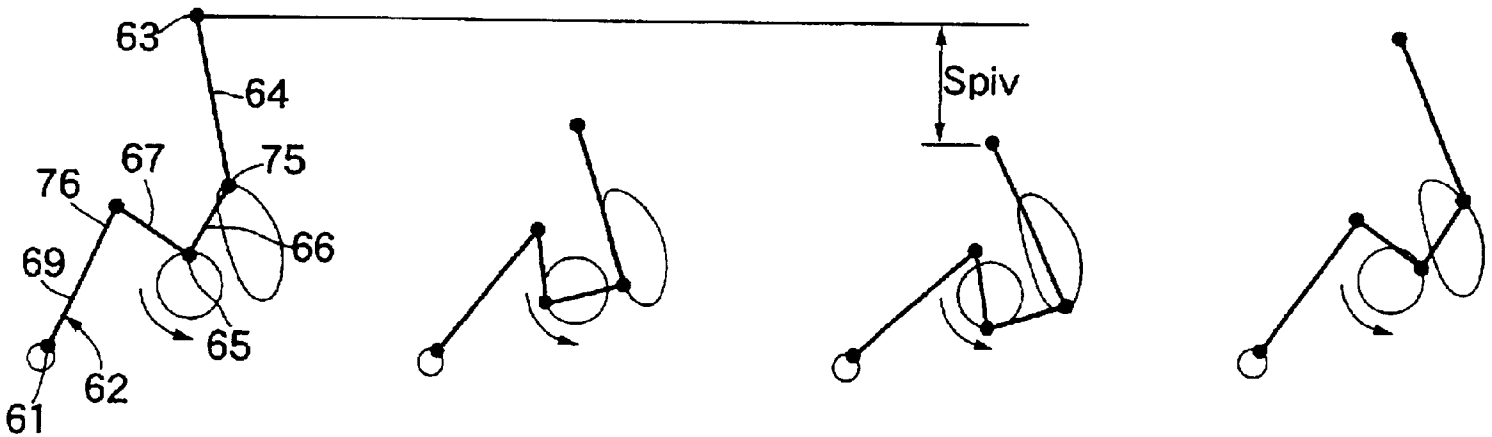
FIG. 9B is a diagram sequentially showing operative states of the link mechanism in a higher-load state of the engine.

In other words, when the support shaft 61 is in a position corresponding to the lower-load state of the engine, the link mechanism 62 is operated as shown in FIG. 9A, and when the support shaft 61 is in a position corresponding to the higher-load state of the engine, the link mechanism 62 is operated as shown in FIG. 9B, and the stroke Spiv of the piston pin 63 in the higher-load state of the engine is larger than the stroke Spiv of the piston pin 63 in the lower-load state of the engine. Moreover, the compression ratio in the lower-load state of the engine is larger than the compression ratio in the higher-load state of the engine and hence, when the load is lower, the engine is operated at a smaller displacement and a higher compression ratio, and when the load is higher, the engine is operated at a larger displacement and a lower compression ratio.

The operation of the first embodiment will be described below. The link mechanism is comprised of the connecting rod 64 connected at one end to the piston 38 through the piston pin 63, the first arm 66 turnably connected at one end to the other end of the connecting rod 64 and at the other end to the crankshaft 27 through the crankpin 65, the second arm 67 integrally connected at one end to the other end of the first arm 66 to constitute the subsidiary rod 68 by cooperation with the first arm 66, and the control rod 69 turnably connected at one end to the other end of the second arm 67. The compression ratio is variable in such a manner that the support shaft 61 supporting the other end of the control rod 69 is displaced in accordance with the operative state of the engine. Moreover, the length L1, of the second arm 67, the length L2 of the first arm 66, the length L3 of the control rod 69, the length L4, of the connecting rod 64, the amount $\delta$ of offsetting of the cylinder axis C from the axis of the crankshaft 27 in the direction of the y-axis and the angle $\alpha$ formed by the first and second arms 66 and 67 are set properly so that the stroke of the piston pin 63 is also variable. Therefore, the engine is operated at the lower compression ratio when the displacement is larger, and the engine is operated at the higher compression ratio when the displacement is smaller.

Figure 10:
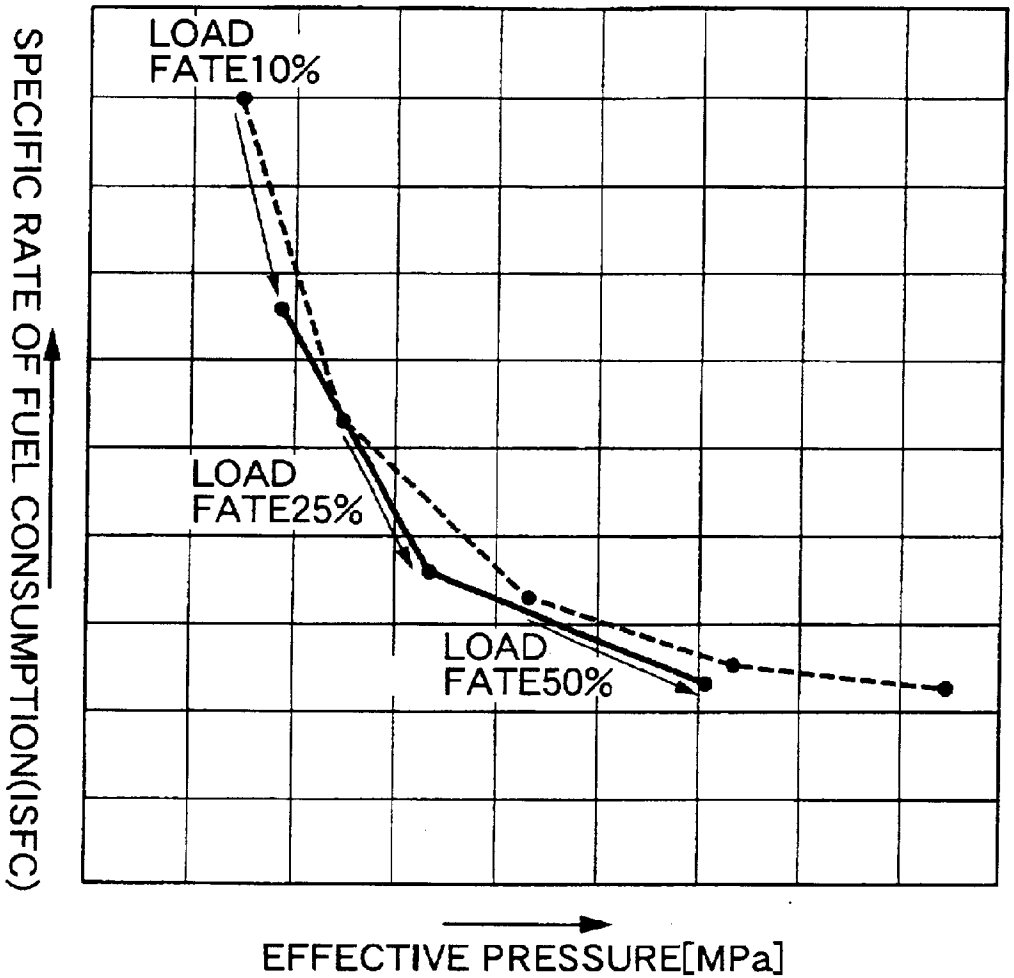

Thus, by operating the engine at the smaller displacement and the higher compression ratio in the lower-load state of the engine, an increase in thermal efficiency is provided, so that the fuel consumption rate can be reduced as shown by a solid line in FIG. 10, as compared with that in the prior art shown by a dashed line, thereby providing a reduction in fuel consumption. By operating the engine at the larger displacement and the lower compression ratio in the higher-load state of the engine, the explosion load and the pressure in the cylinder can be prevented from rising excessively, thereby avoiding problems in noise and strength.

The first and second arms 66 and 67 constitute the subsidiary rod 68 having the semi-circular first bearing portion 70 placed into sliding contact with the half of the periphery of the crankpin 65 by cooperation with each other. The connecting rod 64 is turnably connected to one end of the subsidiary rod 68, and the control rod 69 is turnably connected at one end to the other end of the subsidiary rod 68. The crank cap 73 having the semi-circular bearing portion 74 placed into sliding contact with the remaining half of the periphery of the crankpin 65 is fastened to the pair of semi-circular bifurcated portions 71 and 72 integrally provided on the subsidiary rod 68 in such a manner that the other end of the connecting rod 64 and the one end of the control rod 69 are sandwiched between the semi-circular bifurcated portions 71 and 72. Thus, it is possible to enhance the rigidity of the subsidiary rod 68 mounted to the crankpin 65.

In addition, the connecting rod pin 75 press-fitted into the other end of the connecting rod 64 is turnably fitted at its opposite ends into one 71 of the bifurcated portions, and the subsidiary rod pin 76 relatively rotatably passed through one end of the control rod 69 is clearance-fitted at its opposite ends into the other bifurcated portion 72. Therefore, the portion from the piston 38 to the subsidiary rod 68 and the control rod 69 are assembled separately into the engine, and the subsidiary rod 68 and the control rod 69 can be then connected to each other. In this manner, the assembling operation can be facilitated, while enhancing the assembling accuracy and as a result, an increase in size of the engine can be avoided.

Moreover, since the connecting rod pin 75 and the subsidiary rod 76 are disposed on the extensions of the axes of the bolts 78 for fastening the crank cap 73 to the subsidiary rod 68, the subsidiary rod 68 and the crank cap 73 can be constructed compactly, whereby the weight of the subsidiary rod 68 and the crank cap 73 can be reduced, and the loss of a power can be also suppressed.

In addition, the pair of rotary shafts 81 and 82 are carried on the support portion 83 integrally provided on the case body 25 of the crankcase 22 in the engine body 21 as well as on the support member 84 mounted to the case body 25 with the one-way clutches 85 and 86 interposed therebetween, and the support shaft 61 is mounted between the eccentric positions of the rotary shafts 81 and 82. Moreover, because the support shaft 61 alternately receives the load in the direction to compress the control rod 69 and the load in the direction to pull the control rod 69 in accordance with the motion cycle of the engine, a load for rotating the rotary shafts 81 and 82 in one direction and a load for rotating the rotary shafts 81 and 82 in the other direction are alternately applied to the rotary shafts 81 and 82. However, the rotary shafts 81 and 82 can rotate in only one direction by virtue of the function of the one-way clutches 85 and 86.

Furthermore, the locking member 87 having the restraining projection 88 at the circumferentially one point is fixed to one end of the rotary shaft 81 protruding from the side cover 26 in the engine body 21, and the locker member 93 having the pair of engagement portions 93*a* and 93*b* displaced in phases, for example, by 167 degrees and capable of being engaged with the restraining projection 88 of the locking member 87 is swingably carried on the shaft member 92 fixed to the engine body 21 and having the axis perpendicular to the rotary shaft 81. The locker member 93 is biased by the return spring 107 in the direction to bring one of the engagement portions 93*a* and 93*b* into engagement with the restraining projection 88.

On the other hand, the diaphragm-type actuator 97 comprises the diaphragm 99 whose opposite sides facing the negative pressure chamber 102 leading to the intake passage 46 in the carburetor 34 and the atmospheric pressure chamber 103 opened into the atmospheric air and whose peripheral edge is clamped by the casing 98, and is supported on the engine body 21 and connected to the locker member 93 in such a manner that the locker member 93 is turned in a direction opposite from the spring-biasing direction in accordance with an increase in negative pressure in the negative pressure chamber 102.

Namely, by operating the actuator 97 by means of the load on the engine, the rotary shafts 81 and 82, i.e., the support shaft 61 can be displaced to and retained at one of two points different in phase from each other, for example, by 167 degrees, and the support shaft 61, i.e., the other end of the control rod 69 can be displaced between a position corresponding to the higher compression ratio and a position corresponding to the lower compression ratio. Moreover, the use of the diaphragm-type actuator 97 makes it possible to minimize the power loss of the engine in displacing the control rod 69, while avoiding an increase in the size of the engine and a complicated arrangement in the engine.

Figure 11:
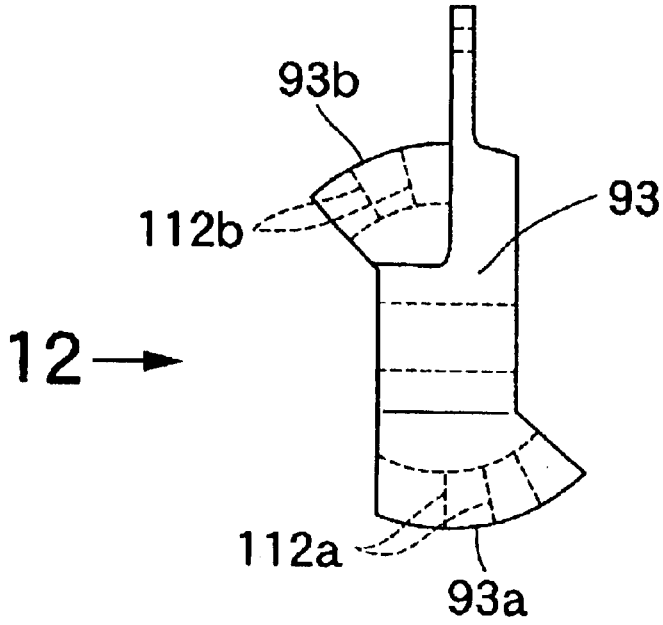
Figure 12:
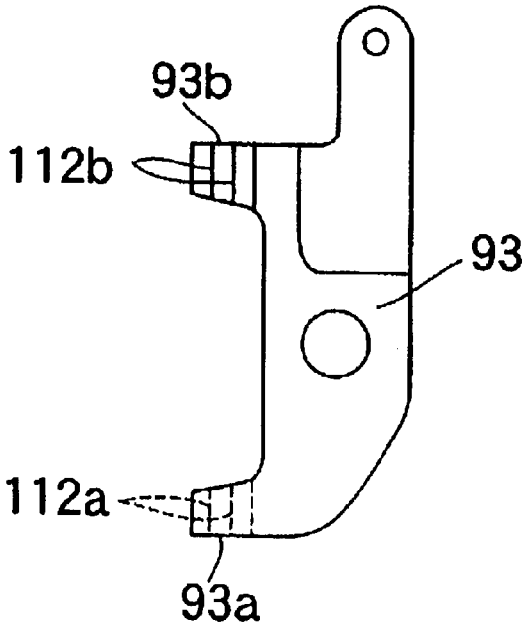

FIGS. 11 and 12 show a second embodiment of the present invention. In the second embodiment, pluralities of steps 112*a* and 112*b* are formed on engagement portions 93*a* and 93*b* of a clocking member 93 and arranged in a circumferential direction of a locking member 87 (see FIGS. 5 and 6) so that they sequentially engage with a restraining projection 88 (see FIGS. 5 and 6) in response to the turning of the locking member 87.

According to the second embodiment, by causing the restraining projection 88 to engage with the steps 112*a* and 112*b*, the circumferential position of the locking member 87 is changed in stages so that the compression ratio can be changed further minutely.

Figure 13:
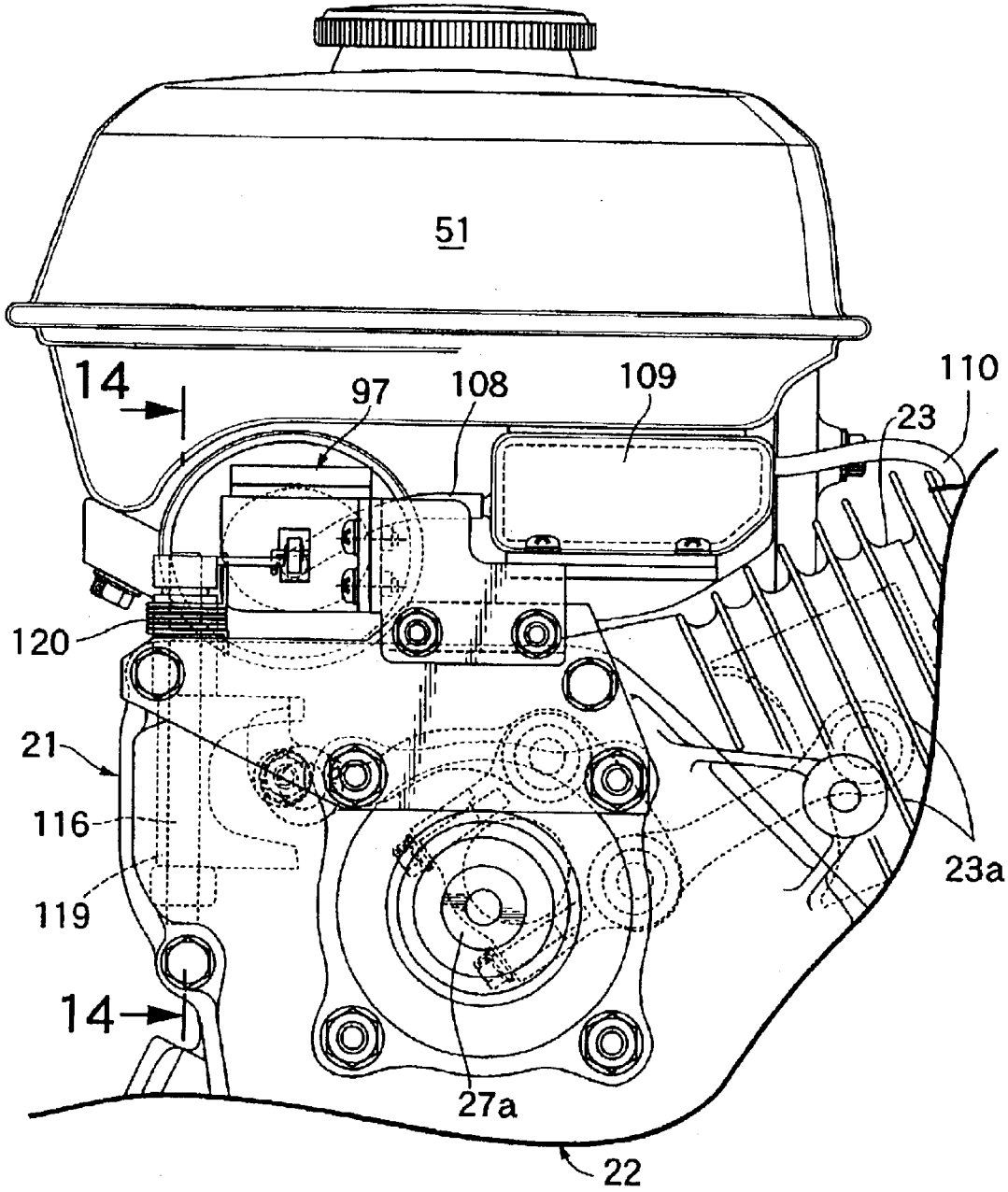
Figure 14:
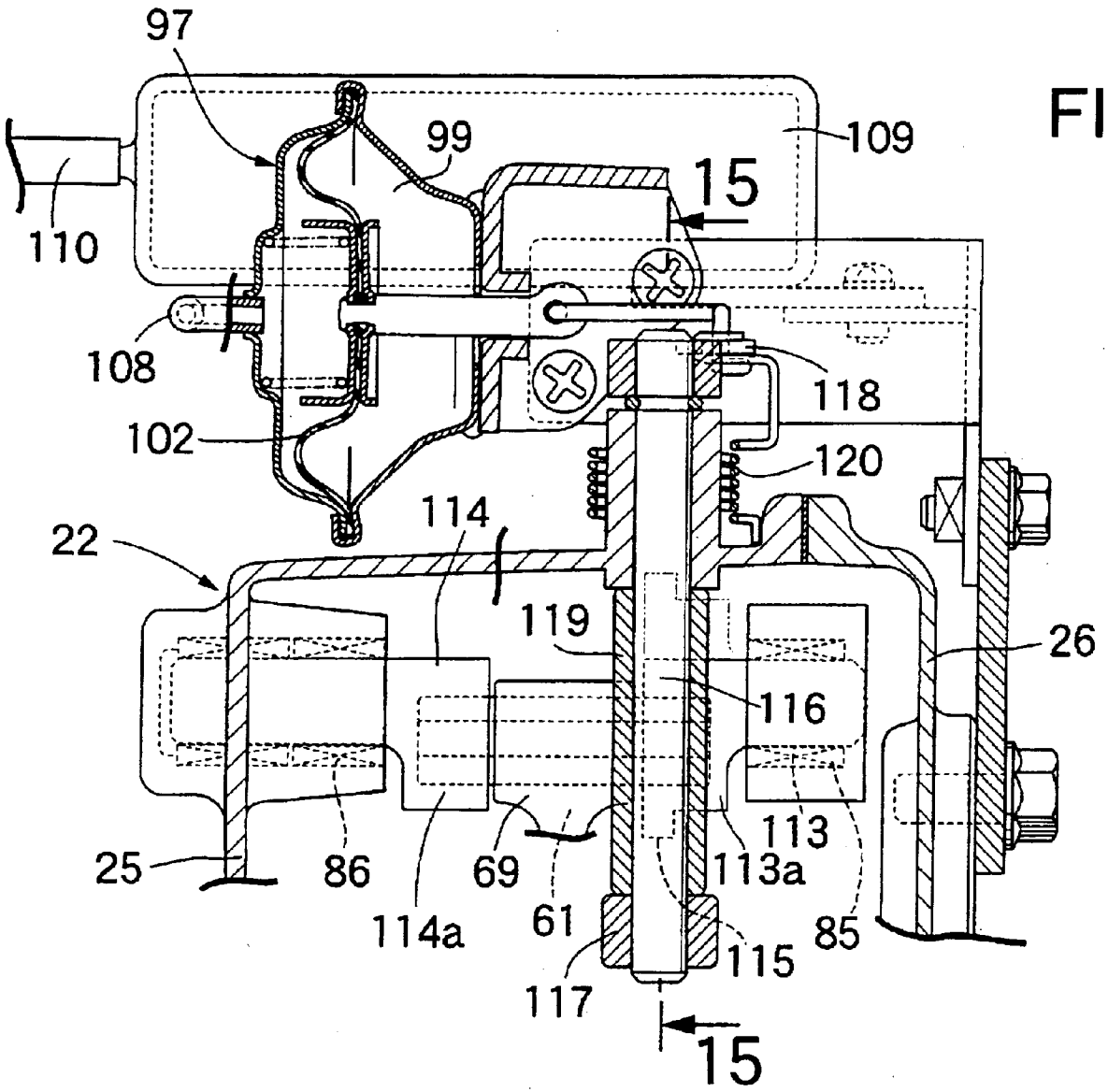

A third embodiment of the present invention will now be described with reference to FIGS. 13 to 18. Referring first to FIGS. 13 and 14, opposite ends of a support shaft 61 turnably connected to the other end of the control rod 69 are disposed between eccentric shaft portions 113*a* and 114*a* of a pair of rotary shafts 113 and 114 disposed coaxially with each other and having axes parallel to the crankshaft 27. The rotary shafts 113 and 114 are turnably carried in the crankcase 22 with a pair of one-way clutches 85 and 86 interposed therebetween.

Moreover, a restraining projection 115 is integrally provided on the eccentric shaft portion 113*a* of one 113 of the rotary shafts at a circumferentially one point to protrude radially outwards.

A shaft member 116 is rotatably mounted perpendicularly to the axes of the rotary shafts 113 and 114 to extend through the case body 25 of the crankcase 22 into the crankcase 22, and is turnably carried at one end on a support portion 117 provided on the crankcase 22.

A lever 118 is fixed to the other end of the shaft member 116 protruding from the crankcase 22, and a diaphragm-type actuator 97 is connected to the lever 118.

A locker member 119 is fixed to the shaft member 116 between an inner surface of a sidewall of the crankcase 22 and the support portion 117 to surround the shaft member 116, and a pair of engagement portions 119*a* and 119*b* are provided on the locker member 119 with their phases displaced from each other, for example, by 167 degrees, so that they can be brought into engagement with the restraining projection 115. A return spring 120 is mounted between the locker member 119 and the crankcase 22 for biasing the locker member 119 for turning movement in a direction to bring one 119*a* of the engagement portions 119*a* and 119*b* of the locker member 119 into engagement with the restraining projection 115.

Figure 15:
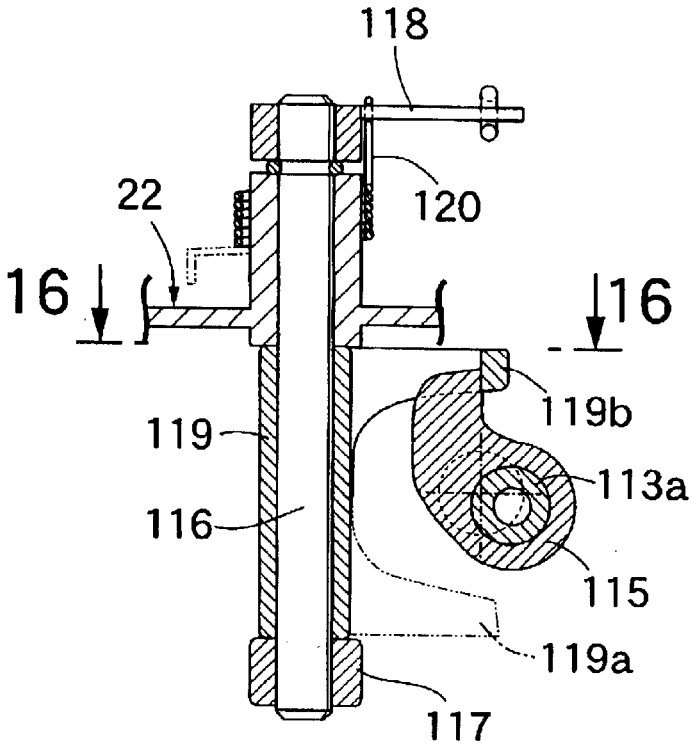
Figure 16:
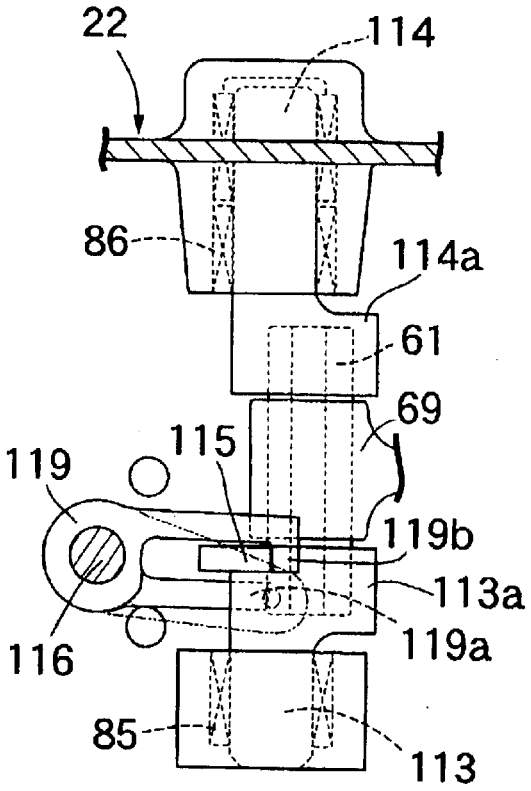

When the engine is in a lower-load operative state in which a negative pressure in the negative pressure chamber 102 in the actuator 97 is higher, the operating rod 101 is in a contacted state. In this state, the turned position of the locker member 119 is a position in which one 119*b* of the engagement portions 119*a* and 119*b* is in engagement with the restraining projection 115, as shown in FIGS. 15 and 16.

Figure 17:
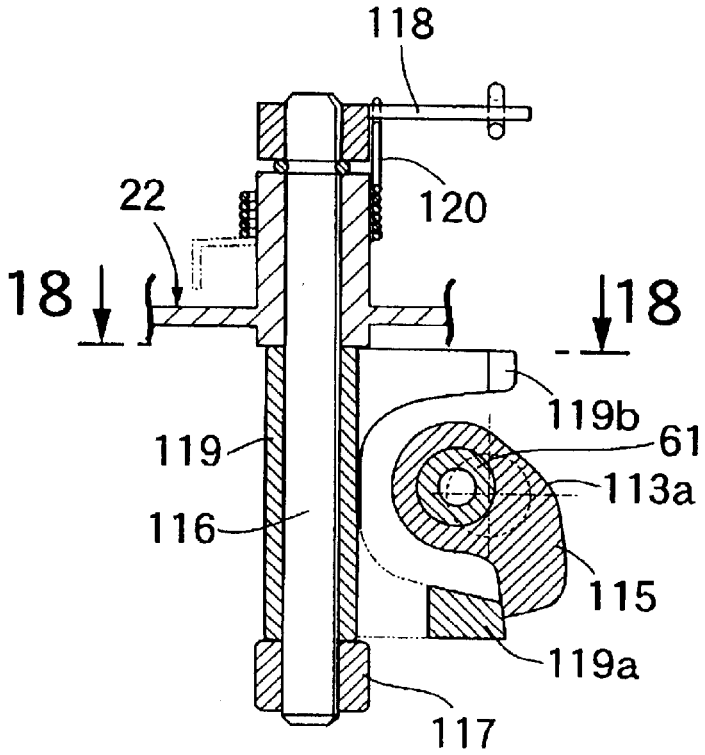
Figure 18:
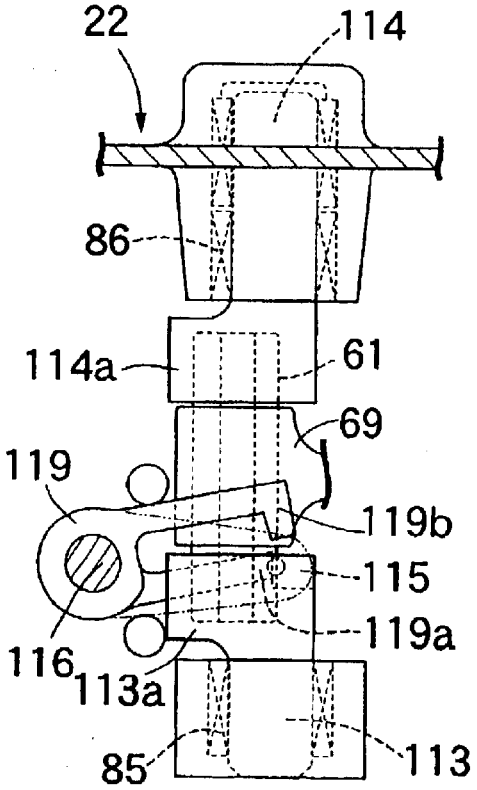

On the other hand, when the engine is brought into a higher-load operative state in which the negative pressure in the negative pressure chamber 102 is lower, the diaphragm 99 is flexed to increase the volume of the negative pressure chamber 102, and the operating rod 101 is expanded. Thus, one 119*a* of the engagement portions 119*a* and 119*b* can be turned to a position in which it is in engagement with the restraining projection 115, as shown in FIGS. 17 and 18.

In this way, the support shaft 61, i.e., the other end of the control rod 69 is displaced between two positions in a plane perpendicular to the axis of the crankshaft 27 by turning the locker member 119 as described above, whereby the compression ratio and the stroke in the engine are changed.

Also according to the third embodiment, the same effect as in the first embodiment can be provided.

Figure 19:
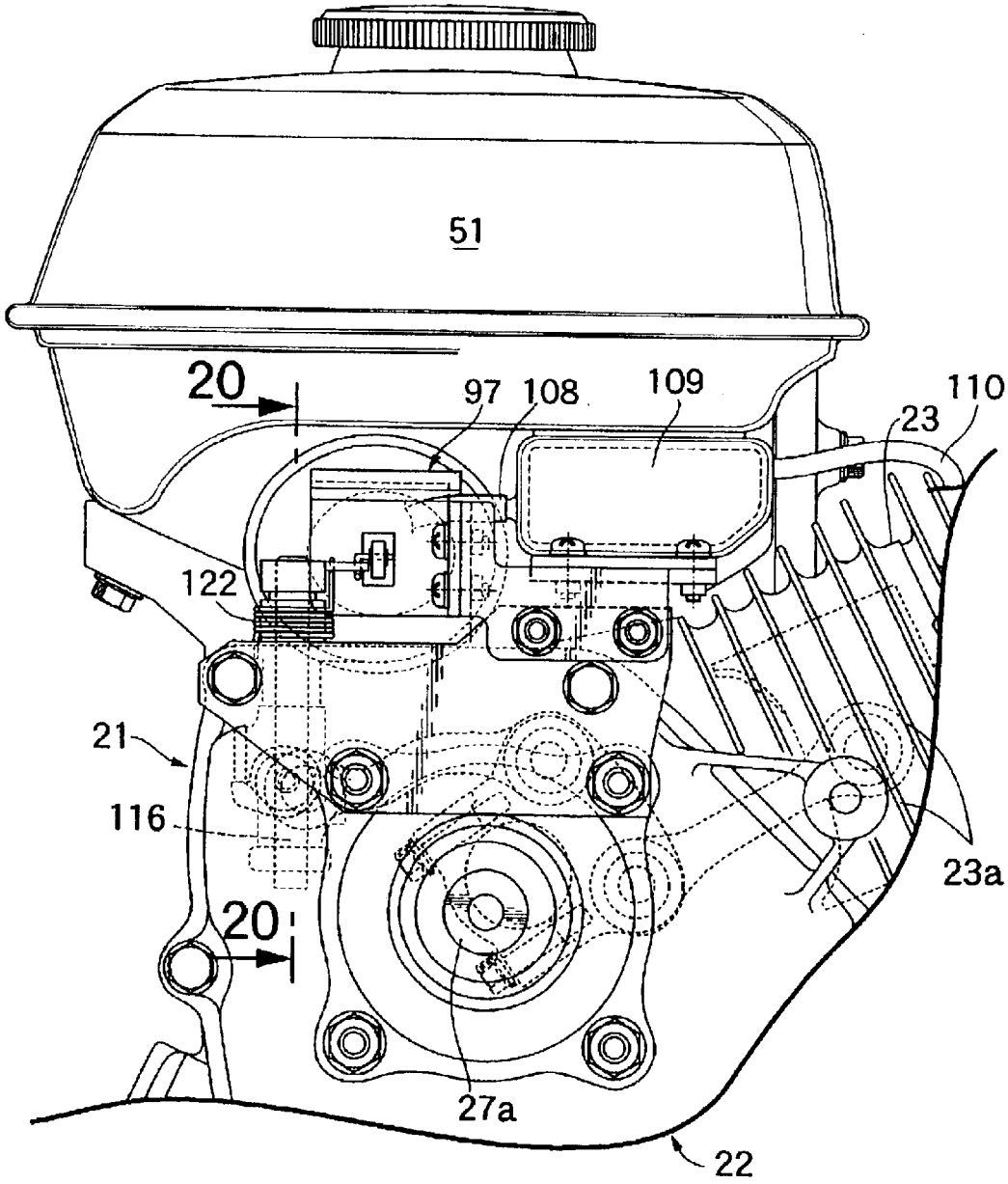
Figure 20:
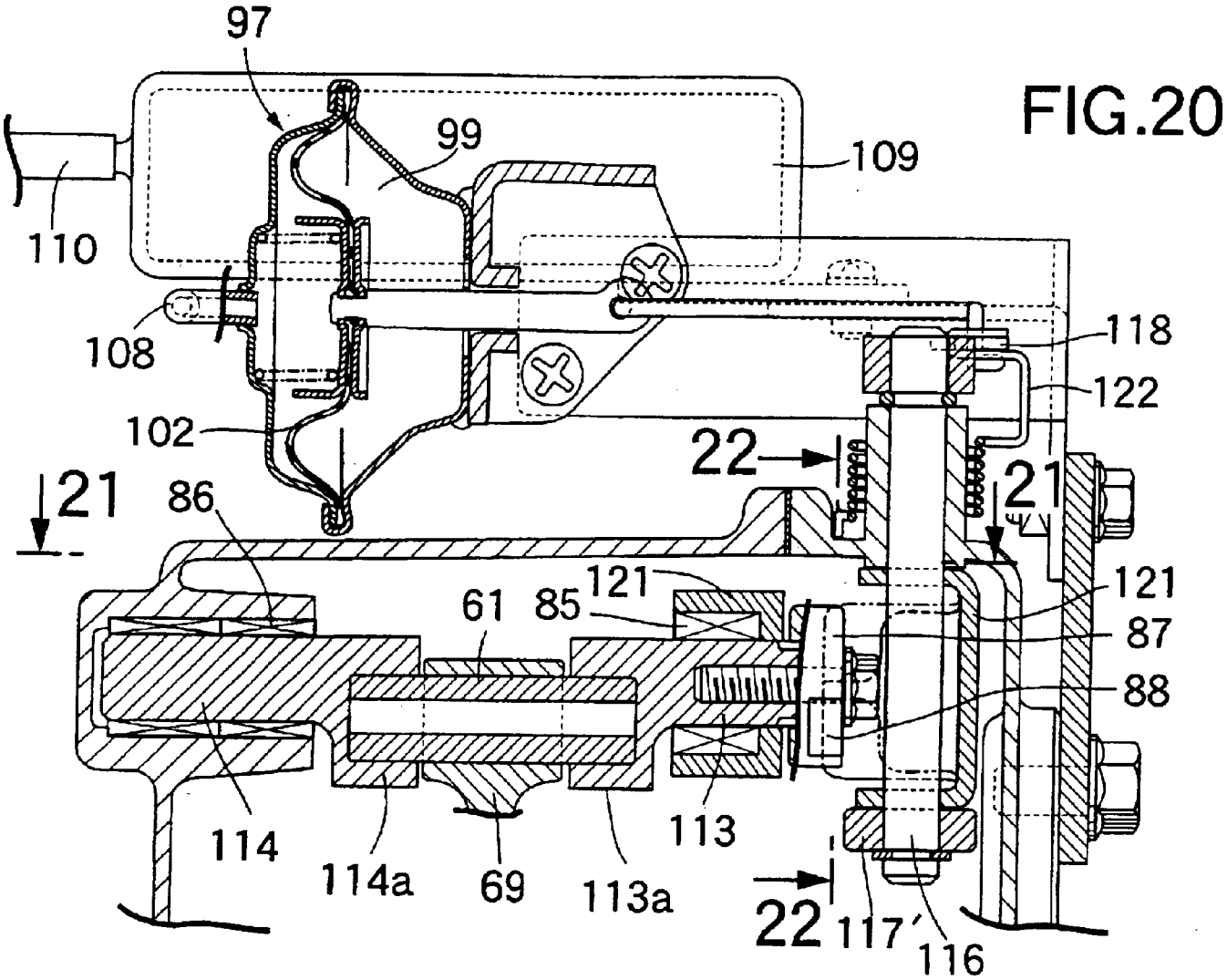

A fourth embodiment of the present invention will now be described with reference to FIGS. 19 to 24. Referring first to FIGS. 19 and 20, opposite ends of a support shaft 61 are turnably connected to the other end of the control rod 69, and disposed between eccentric shaft portions 113*a* and 114*a* of a pair of rotary shafts 113 and 114 disposed coaxially with each other and having axes parallel to the crankshaft 27. The rotary shafts 113 and 114 are turnably carried in the crankcase 22 with a pair of one-way clutches 85 and 86 interposed therebetween.

Moreover, the rotary shaft 113 extends through a support portion 121 provided on the crankcase 22, and a disk-shaped locking member 87 having a restraining projection 88 protruding radially outwards at circumferentially one point is fixed to one end of the rotary shaft 113.

A shaft member 116 is rotatably mounted perpendicularly to the axes of the rotary shafts 113 and 114 to extend through the side cover in the crankcase 22 into the crankcase 22, and is turnably carried at one end on a support portion 117' provided on the crankcase 22.

A lever 118 is fixed to the other end of the shaft member 116 protruding from the crankcase 22, and a diaphragm-type actuator 97 is connected to the lever 118.

A locker member 121 is fixed to the shaft member 116 between an inner surface of a sidewall of the crankcase 22 and the support portion 117', and a pair of engagement portions 121*a* and 121*b* are provided on the locker member 121 with their phases displaced from each other, for example, by 167 degrees, so that they can be brought into engagement with the restraining projection 88. A return spring 122 is mounted between the locker member 121 and the crankcase 22, and biases the locker member 121 for turning movement in a direction to bring one 121*a* of the engagement portions 121*a* and 121*b* of the locker member 121 into engagement with the restraining projection 88.

Figure 21:
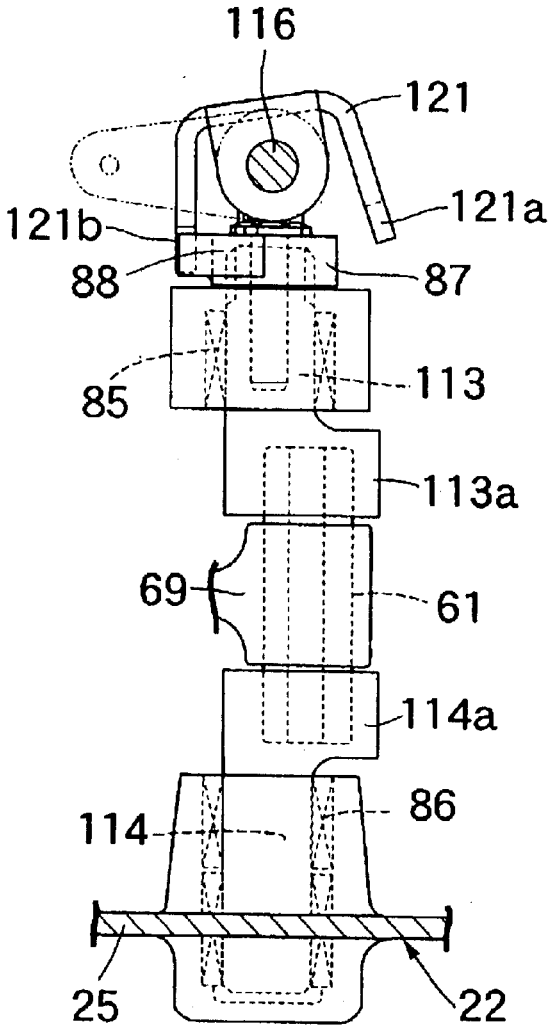
Figure 22:
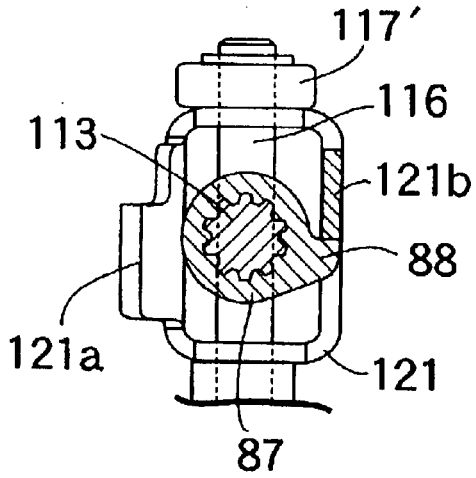

When the engine is in a lower-load operative state in which a negative pressure in the negative pressure chamber 102 in the actuator 97 is higher, the operating rod 101 is in a contacted state. In this state, the turned position of the locker member 121 is a position in which one 121*b* of the engagement portions 121*a* and 121*b* is in engagement with the restraining projection 88, as shown in FIGS. 21 and 22.

Figure 23:
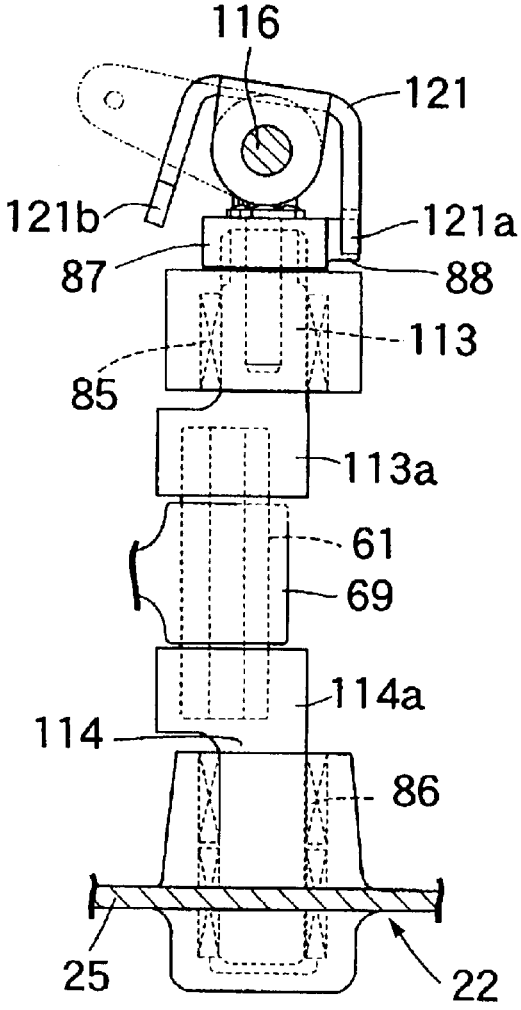
Figure 24:
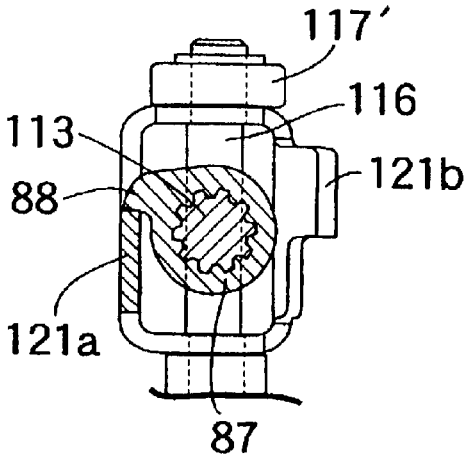

On the other hand, when the engine is brought into a higher-load operative state in which the negative pressure in the negative pressure chamber 102 is lower, the diaphragm 99 is flexed to increase the volume of the negative pressure chamber 102, and the operating rod 101 is expanded. Thus, one 121*a* of the engagement portions 121*a* and 121*b* can be turned to a position in which it is in engagement with the restraining projection 88, as shown in FIGS. 23 and 24.

In this way, the support shaft 61, i.e., the other end of the control rod 69 is displaced between two positions in a plane perpendicular to the axis of the crankshaft 27 by turning the locker member 121 as described above, whereby the compression ratio and the stroke in the engine are changed.

Also according to the fourth embodiment, the same effect as in the first embodiment can be provided.

When the piston 38 is in a first half of an expansion stroke, a large load is applied to the piston 38 by the combustion in the combustion chamber, but if the angle of inclination of the connecting rod 64 is larger at that time, the pressure of contact of the piston 38 with the inner surface of the cylinder bore 39 is larger, resulting in an increase in friction. When the displacement is largest in the higher-load state of the engine, a portion of the inner surface of the cylinder bore 39 is also exposed to the combustion chamber 40, and there is a possibility that carbon produced from the combustion is deposited and accumulated on the portion of the inner surface of the cylinder bore 39. In this state kept intact, when the displacement is reduced to the minimum in the lower-load state of the engine, the piston ring mounted on the piston 38 slides on the accumulated carbon, causing disadvantages such as sticking and abnormal wear of the piston ring and poor sealing of combustion gas. Therefore, an arrangement designed so that such disadvantages can be eliminated will be described below in a fifth embodiment To reduce the friction, a locus of movement of the piston pin 63 is determined to be fallen into a range between the x-axis and a straight line extending in parallel to the x-axis through one of points of connection between the connecting rod 64 and the first arm 66 when the piston 38 is at the top dead center, i.e., one of positions of the connecting rod pin 75, which is farthest from the x-axis in the direction of the y-axis.

Figure 25B:
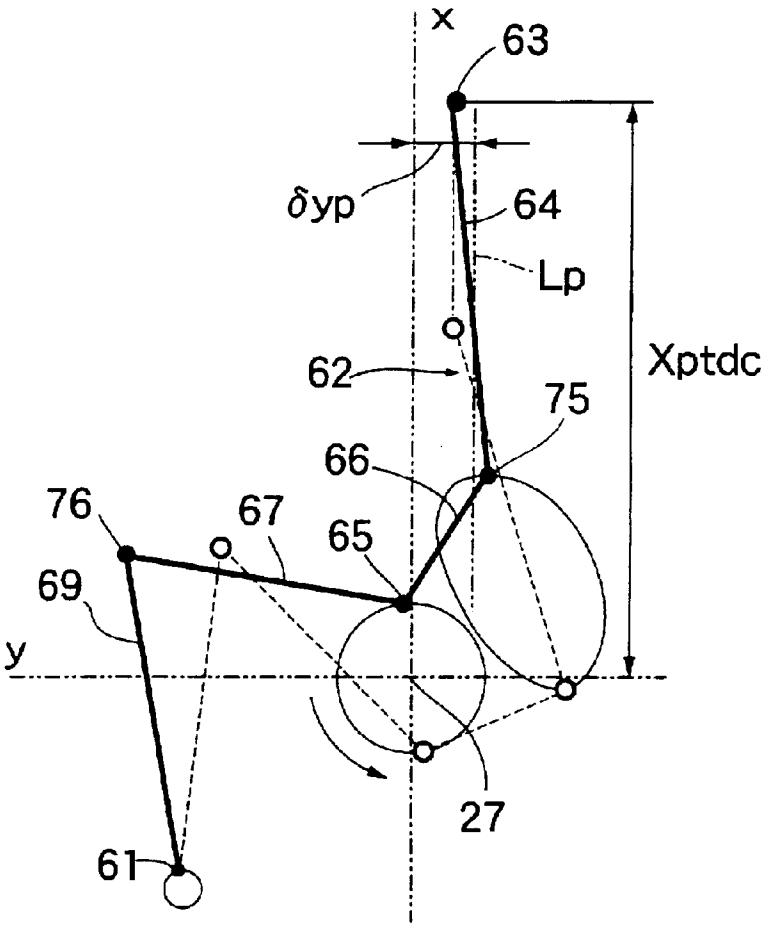
FIG. 25B is a diagram showing operative states of the link mechanism in a higher-load state of the engine.
Figure 25A:
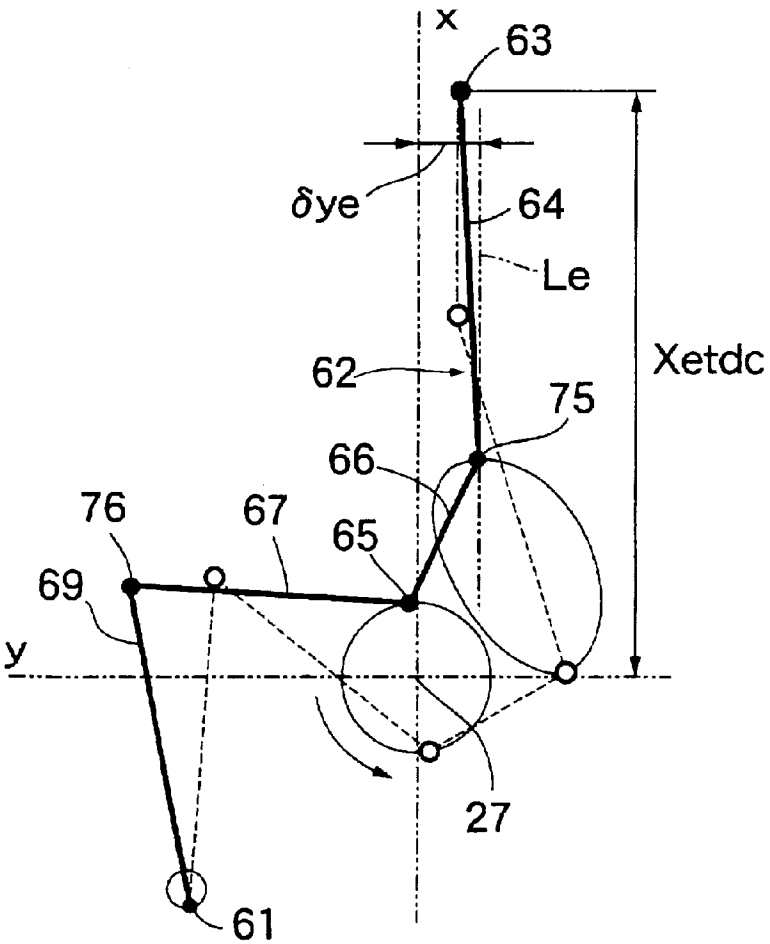
FIG. 25A is a diagram showing operative states of a link mechanism in a lower-load state of the engine.

More specifically, in the lower-load state of the engine, as shown in FIG. 25A, the link mechanism 62 is operated between a state in which the piston 38 is at the top dead center (a state shown by a solid line), and a state in which the piston 38 is at the bottom dead center (a state shown by a dashed line), and there is a distance δye along the y-axis between the x-axis and a straight line Le extending in parallel to the x-axis through the position of the connecting rod pin 75 when the piston 38 is at the top dead center. On the other hand, in the higher-load state of the engine, as shown in FIG. 25B, the link mechanism 62 is operated between a state in which the piston 38 is at the top dead center (a state shown by a solid line), and a state in which the piston 38 is at the bottom dead center (a state shown by a dashed line), and there is a distance δyp along the y-axis between the x-axis and a straight line Lp extending in parallel to the x-axis through the position of the connecting rod pin 75 when the piston 38 is at the top dead center, wherein $\delta ye<\delta yp$. Therefore, the locus of movement of the piston pin 63 is determined to be fallen a range between the straight line Lp and the x-axis.

If the locus of movement of the piston pin 63 is determined in the above-described manner, the angle of inclination of the connecting rod 64 can be suppressed in the first half of the expansion stroke, although the piston receives the larger load due to the combustion in the combustion chamber 40 in the first half of the expansion stroke. Therefore, the friction can be reduced, while the pressure of contact of the piston 38 with the inner surface of the cylinder bore 39 is prevented from increasing.

Figures 26A, 26B:
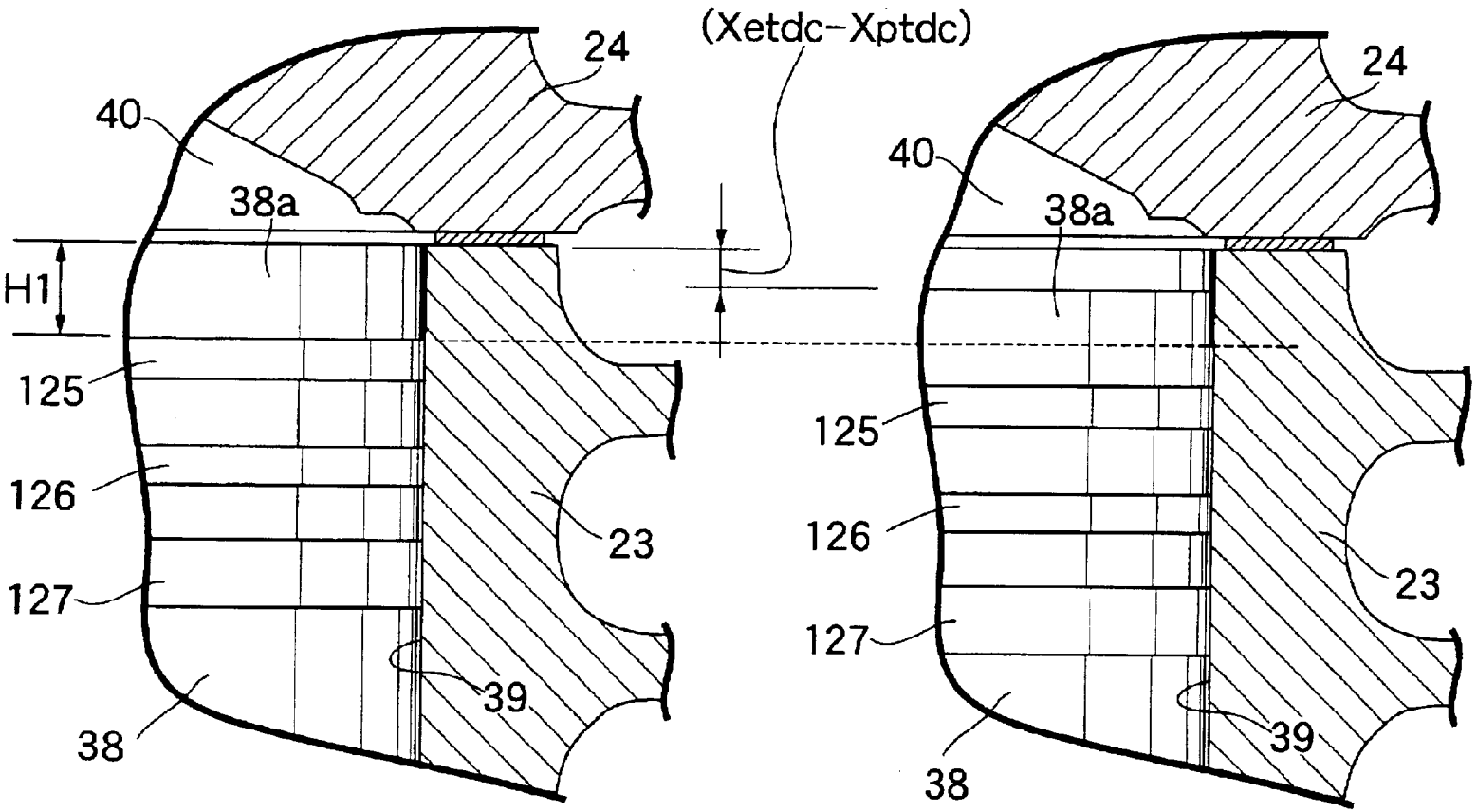
FIG. 26A is a sectional view showing an area near a combustion chamber in the lower-load state of the engine.
FIG. 26B is a sectional view showing the area near the combustion chamber in the higher-load state of the engine.

The piston rings 125, 126 and 127 are mounted on the piston 38, as shown in FIGS. 26A and B, and if a width of a top land 38*a* which is a region extending from one 125 of the piston rings 125 to 127 on the piston 38 toward the combustion chamber 40 is represented by H1; a level of the piston pin 63 along the x-axis at the top dead center when the displacement is smallest in the lower-load state of the engine as shown in FIG. 26A is represented by Xetdc; and a level of the piston pin 63 along the x-axis at the top dead center when the displacement is largest in the higher-load state of the engine as shown in FIG. 26B is represented by Xptdc, these values are determined so that a relation, $Xetdc-Xptdc \leqq H1$.

If the values are determined as described above, when the displacement is largest in the higher-load state of the engine, a portion of the inner surface of the cylinder bore 39 is also exposed to the combustion chamber 40, and there is a possibility that carbon produced from the combustion is deposited and accumulated on the portion of the inner surface of the cylinder bore 39. However, when the displacement is smallest in the lower-load state of the engine, it is possible to prevent one 125 of the piston rings 125 to 127 mounted on the piston 38, which is closest-to the combustion chamber 40, from sliding on the accumulated carbon. Therefore, it is possible to eliminate the disadvantages such as sticking and abnormal wear of the piston ring 125 and poor sealing of combustion gas.

Figure 27:
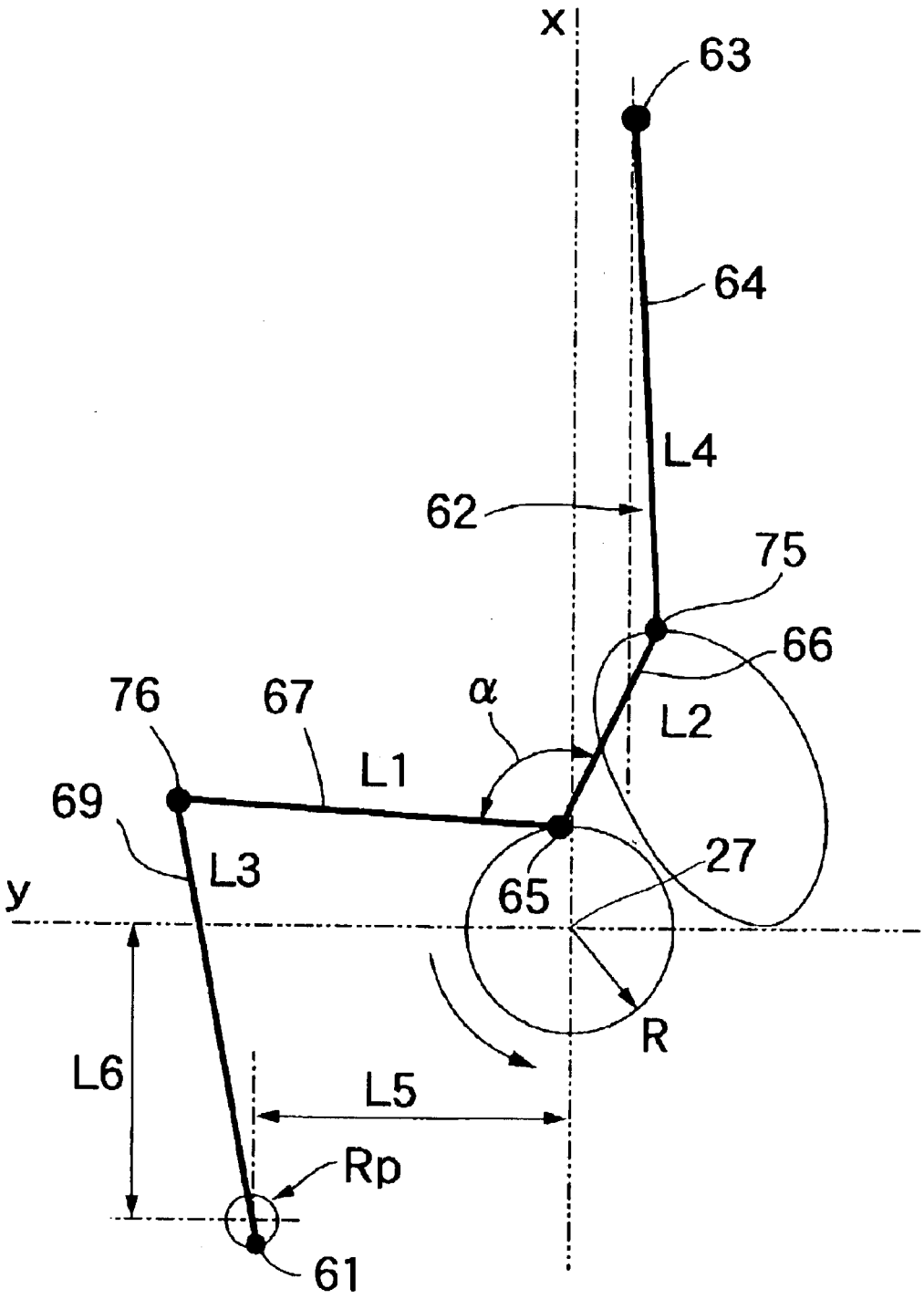

As shown in FIG. 27, the support shaft 61 is displaced to describe a circular locus having a radius Rp about a point spaced within an x-y plane apart from the axis of the crankshaft 27 by lengths L5 and L6 in the directions of the y-axis and the x-axis, respectively. When a length R between the axis of the crankshaft 27 and the crankpin 65 is set at 1.0; the length L1, the second arm 67 is set in a range of 1.5 to 6.0; the length L2 of the first arm 66 is set in a range of 1.0 to 5.5; the length L3 of the control rod 69 is set in a range of 3.0 to 6.0; the length L5 is set in a range of 1.2 to 6.0; the length L6 is set in a range of 0.9 to 3.8; and the radius Rp is set in a range of 0.06 to 0.76, as well as the angle α formed by the first and second arms 66 and 67 is set in a range of 77 to 150 degrees.

If the dimensions of the various portions of the link mechanism 62 are determined as described above, the angle of inclination of the connecting rod 64 can be suppressed in the first half of the expansion stroke. Moreover, when the displacement is smallest, it is possible to prevent the piston ring 125 from sliding on the carbon accumulated on the inner surface of the cylinder bore 39. Therefore, it is possible to reduce the friction during sliding of the piston and to eliminate the disadvantages such as sticking and abnormal wear of the piston ring and poor sealing of combustion gas.

Although the embodiments of the present invention have been described in detail, it will be understood that the present invention is not limited to the above-described embodiments, and various modifications in design may be made without departing from the spirit and scope of the invention defined in the claims.

Although the diaphragm-type actuator 97 is used for displacing the support shaft 61 in the embodiments, for example, an electronically controlled switchover mechanism using an electric motor and the like may be used for displacing the support shaft 61.

What is claimed is:

1. An engine with a variable compression ratio, comprising a connecting rod connected at one end to a piston through a piston pin, a first arm turnably connected at one end to the other end of said connecting rod and at the other end to a crankshaft through a crankpin, a second arm integrally connected at one end to the other end of said first arm, a control rod turnably connected at one end to the other end of said second arm, and a support shaft for supporting the other end of said control rod for turning movement, the position of said support shaft being displaceable within an x-y plane constituted by an x-axis extending through an axis of said crankshaft along a cylinder axis and a y-axis extending through the axis of said crankshaft in a direction perpendicular to said x-axis, wherein when a length of said connecting rod is represented by L4; a length of said first arm is represented by L2; a length of said second arm is represented by L1;

a length of said control rod is represented by L3; an angle formed by said connecting rod with said x-axis is represented by $\phi 4$; an angle formed by said first and second arms is represented by $\alpha$; an angle formed by said second arm with said y-axis is represented by $\phi 1$; an angle formed by said control rod with said y-axis is represented by $\phi 3$; an angle formed by a straight line connecting the axis of said crankshaft and said crankpin with said x-axis is represented by $\theta$; a length between the axis of said crankshaft and said crankpin is represented by R; x-y coordinates of said support shaft are represented by Xpiv and Ypiv; a rotational angular speed of said crankshaft is represented by $\omega$; and an amount of offsetting of said cylinder axis from the axis of said crankshaft in a direction of the y-axis is represented by $\delta$, the following equation is established:

$$-L4\cdot\sin\phi 4\cdot d\phi 4/dt+L2\cdot\cos(\alpha+\phi 1)\cdot d\phi 1/dt-R\cdot\omega\cdot\sin\theta=0$$

wherein $\phi 4=\arcsin\{L2\cdot\cos(\alpha+\phi 1)+R\cdot\sin\theta-\delta\}/L4$ $d\phi 4/dt=\omega\cdot\{-L2\cdot\sin(\alpha+\phi 1)\cdot R\cdot\cos(\theta-\phi 3)/L1\cdot\sin(\phi 1+\phi 3)+R\cdot\cos\theta\}/(L4\cdot\cos\phi 4)$ $\phi 3=\arcsin\{(R\cdot\cos\theta-Xpiv+L1\cdot\sin\phi 1)\}/L3\}$ $\phi 1=\arcsin\{(L3^2-L1^2-C^2-D^2)/2\cdot L1\cdot\sqrt{(C^2+D^2)}\}-\arctan(C/D)$ $C=Ypiv-R\sin\theta$ $D=Xpiv-R\cos\theta$ $d\phi 1/dt=\omega\cdot R\cdot\cos(\theta-\phi 3)/\{L1\cdot\sin(\phi 1+\phi 3)\}$, and the crank angles $\theta$ at a top dead center and a bottom dead center of said piston pin at the time when said support shaft is in a first position are determined by introducing L1, to L4, $\delta$ and R each set at any value into said equation; a displacement Vhpiv0 and a compression ratio $\epsilon$piv0 at the time when said support shaft is in the first position and a displacement Vhpiv1 and a compression ratio $\epsilon$piv1 at the time when said support shaft is in a second position displaced from the first position are determined from the following equation representing a level X of said piston pin at both said crank angles $\theta$:

$$X=L4\cdot\cos\phi 4+L2\cdot\sin(\alpha+\phi 1)+R\cdot\cos\theta;$$

and the length L1, of said second arm, the length L2 of said first arm, the length L3 of said control rod, the length L4 of said connecting rod, the amount $\delta$ of offsetting of the cylinder axis from the axis of said crankshaft in the direction of the y-axis and the angle $\alpha$ formed by said first and second arms are determined, so that the following relations are satisfied:

$$Vhpiv1>Vhpiv0 \text{ when } \epsilon piv1<\epsilon piv0, \text{ and}$$

$$Vhpiv1<Vhpiv0 \text{ when } \epsilon piv1>\epsilon piv0.$$

2. An engine with a variable compression ratio according to claim 1, wherein a locus of movement of said piston pin is determined to be fallen in a range between said x-axis and a straight line extending in parallel to said x-axis through one of positions of points of connection between said connecting rod and said first arm when said piston is at the top dead center, which is farthest from said x-axis in the direction of the y-axis.

3. An engine with a variable compression ratio according to claim 1 or 2, wherein when a level of said piston pin in the direction of the x-axis at the top dead center at the time when the displacement is smallest is represented by Xetdc; a level of said piston pin in the direction of the x-axis at the top dead center at the time when the displacement is largest is represented by Xptdc; and a width of a top land of said piston is represented by H1, these values are determined so that a relation, $Xetdc-Xptdc\leqq H1$ is established.

4. An engine with a variable compression ratio according to claim 1, wherein said support shaft is displaced to describe a circular locus having a radius Rp about a point spaced within said x-y plane from the axis of said crankshaft by lengths L5 and L6 apart in the directions of the y-axis and the x-axis, respectively, and wherein when the length R between the axis of said crankshaft and said crankpin is set at 1.0, the length L1, of said second arm is set in a range of 1.5 to 6.0; the length L2 of said first arm is set in a range of 1.0 to 5.5; the length L3 of said control rod is set in a range of 3.0 to 6.0; said length L5 is set in a range of 1.2 to 6.0; said length L6 is set in a range of 0.9 to 3.8; and said radius Rp is set in a range of 0.06 to 0.76, as well as the angle $\alpha$ formed by said first and second arms is set in a range of 77 to 150 degrees.

* * * * *